US009858743B2

(12) United States Patent
Wakabayashi et al.

(10) Patent No.: US 9,858,743 B2
(45) Date of Patent: Jan. 2, 2018

(54) MEDIUM HOUSING DEVICE AND MEDIUM PROCESSING DEVICE

(71) Applicant: Oki Electric Industry Co., Ltd., Tokyo (JP)

(72) Inventors: Madoka Wakabayashi, Tokyo (JP); Kei Iwatsuki, Tokyo (JP); Kousuke Moribayashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 67 days.

(21) Appl. No.: 14/761,919

(22) PCT Filed: Nov. 8, 2013

(86) PCT No.: PCT/JP2013/080319
§ 371 (c)(1),
(2) Date: Jul. 17, 2015

(87) PCT Pub. No.: WO2014/115398
PCT Pub. Date: Jul. 31, 2014

(65) Prior Publication Data

US 2015/0356807 A1 Dec. 10, 2015

(30) Foreign Application Priority Data

Jan. 23, 2013 (JP) ..... 2013-010346

(51) Int. Cl.
*G07F 7/04* (2006.01)
*G07D 11/00* (2006.01)
(Continued)

(52) U.S. Cl.
CPC ..... *G07D 11/0006* (2013.01); *B65H 1/025* (2013.01); *B65H 3/063* (2013.01);
(Continued)

(58) Field of Classification Search
CPC ..... E04B 2001/2406; E04B 2001/2409; E04B 1/54; E04B 1/5843; G07D 11/003;
(Continued)

(56) References Cited

U.S. PATENT DOCUMENTS 4,494,743 A * 1/1985 Kushmaul ..... B65H 3/0891 271/107
4,529,119 A * 7/1985 Granzow ..... E05G 5/006 109/43
(Continued)

FOREIGN PATENT DOCUMENTS

CN 101097637 A 1/2008
JP H07-12346 U 2/1995
(Continued)

*Primary Examiner* — Jeffrey Shapiro
(74) *Attorney, Agent, or Firm* — Rabin & Berdo, P.C.

(57) ABSTRACT

A medium housing device includes: a frame including an internal space; a partitioning plate that partitions the internal space so as to intersect with a specific collection direction, and that forms a collection space in which the medium is collected along the collection direction; a partitioning plate moving section that moves the partitioning plate along the collection direction; a side guide that is attached inside the frame and that determines the size of the collection space in an intersecting direction intersecting with the collection direction; a positioning portion that positions an end portion of the side guide at one attachment position selected from a plurality of attachment positions; and a retention switching portion that switches between a retained state in which the end portion of the side guide is positioned, and a retention-released state in which the end portion of the side guide is not positioned.

9 Claims, 15 Drawing Sheets

(51) Int. Cl.

| | |
|---|---|
| ***B65H 31/34*** | (2006.01) |
| ***B65H 31/20*** | (2006.01) |
| ***B65H 83/02*** | (2006.01) |
| ***B65H 1/02*** | (2006.01) |
| ***B65H 3/06*** | (2006.01) |

(52) U.S. Cl.
CPC ..... *B65H 3/0653* (2013.01); *B65H 31/20* (2013.01); *B65H 31/34* (2013.01); *B65H 83/02* (2013.01); *G07D 11/0012* (2013.01); *G07D 11/0018* (2013.01); *B65H 2301/4213* (2013.01); *B65H 2301/42142* (2013.01); *B65H 2301/4314* (2013.01); *B65H 2402/5152* (2013.01); *B65H 2405/214* (2013.01); *B65H 2511/12* (2013.01); *B65H 2511/20* (2013.01); *B65H 2701/1912* (2013.01)

(58) Field of Classification Search
CPC ..... G07D 11/0003; G07D 11/0006; G07D 11/0009; G07D 11/0012; G07D 11/0015; G07D 11/0021; G07D 11/0018; Y10T 403/4648; Y10T 403/4662; Y10T 403/4665; Y10T 403/4668; Y10S 902/08; Y10S 902/09; Y10S 902/14; Y10S 902/15; Y10S 902/17; B65H 2301/4314; B65H 2701/1912; B65H 1/18; B65H 1/20; B65H 1/26; B65H 1/263; B65H 1/30; B65H 1/28; B65H 2405/113; B65H 2405/114; B65H 31/34; B65H 31/20; B65H 83/02; B65H 2301/4213; B65H 2301/42142; B65H 2405/214; B65H 2511/12; B65H 2511/20; B65H 1/025; B65H 3/063; B65H 3/0653; B65H 2402/5152; B65H 2220/04; B65H 2220/11; B65H 2220/01; B65H 1/027; B65H 1/04; B65H 2405/31; B65H 2405/32; B65H 2405/361; B65H 1/06; B65H 3/042; B65H 3/5276; B65H 1/24; B65H 3/32; B65H 3/34; B65H 3/46; B65H 3/56; B65H 3/58; B65H 2405/13; B65H 2405/10; B65H 2405/116; B65H 2405/112
USPC ..... 194/206, 207; 235/379; 209/534; 403/247, 252–254, 46, 48; 271/127, 271/145–171; 902/9, 10, 13–15, 17
See application file for complete search history.

(56) References Cited

U.S. PATENT DOCUMENTS

| | | | | |
|---|---|---|---|---|
| 4,593,895 | A * | 6/1986 | Myers | B65H 1/04 271/148 |
| 5,624,017 | A * | 4/1997 | Plesko | G07D 7/00 194/207 |
| 7,214,022 | B2 * | 5/2007 | Melching | B65G 1/0407 414/277 |
| 7,413,188 | B2 * | 8/2008 | Miki | B65H 1/266 271/171 |
| 7,886,888 | B1 * | 2/2011 | Chien | B65H 29/46 194/206 |
| 8,733,634 | B1 * | 5/2014 | Eastman | G07D 11/0081 235/375 |
| 9,315,355 | B2 * | 4/2016 | Aoji | B65H 31/24 |
| 2006/0157916 | A1 * | 7/2006 | Ahn | B65H 1/02 271/145 |
| 2007/0151827 | A1 * | 7/2007 | Brandstrom | G07D 1/02 194/206 |
| 2008/0001349 | A1 | 1/2008 | Park et al. | |
| 2010/0052237 | A1 * | 3/2010 | Herczeg | B65H 7/00 271/3.16 |
| 2010/0200448 | A1 * | 8/2010 | Doi | G07D 9/00 206/459.1 |
| 2012/0090140 | A1 * | 4/2012 | Montemayor | E04H 17/143 24/593.1 |
| 2014/0217669 | A1 * | 8/2014 | Aoji | B65H 31/22 271/297 |

FOREIGN PATENT DOCUMENTS

| | | |
|---|---|---|
| JP | 2006-127050 A | 5/2006 |
| JP | 2012-076914 A | 4/2012 |

* cited by examiner

MEDIUM HOUSING DEVICE AND MEDIUM PROCESSING DEVICE

TECHNICAL FIELD

This application claims priority from Japanese Patent application No. 2013-010346 filed on Jan. 23, 2013, the disclosure of which is incorporated by reference herein.

The present invention relates to a medium housing device and a medium processing device, and may, for example, be applied to an automated teller machine (ATM) that is input with a medium such as banknotes to perform desired transactions.

BACKGROUND ART

Hitherto, ATMs, etc. employed in financial institutions and the like are, for example, configured to deposit cash such as banknotes and coins for a user, and to pay out cash to a user, according to the contents of a user transaction.

For example, ATMs have been proposed including a customer interface that exchanges banknotes with a user, a conveyance section that conveys banknotes, a classification section that classifies inserted banknotes by denomination and authenticity, a temporary holding section that temporarily stores inserted banknotes, and banknote cassettes that store banknotes by denomination.

In such an ATM, during a pay-in transaction, when banknotes are inserted into the customer interface by a user, the inserted banknotes are conveyed to the classification section and classified, and banknotes classified as normal banknotes are temporarily stored in the temporary holding section, and banknotes determined to be unsuitable for transaction are replaced in the customer interface for return to the user. The ATM then confirms the amount to be deposited by the user, feeds out the banknotes stored in the temporary holding section for reclassification by denomination in the classification section, and stores each of the banknotes in the banknote cassettes according to their classified denomination.

Such customer interfaces include a configuration internally formed with a collection space for housing banknotes in a collected state, and a plate-shaped partitioning plate is moved along the direction in which the banknotes are stacked (referred to hereafter as the collection direction) to vary the size of the collection space (see, for example, Japanese Patent Application Laid-Open (JP-A) No. 2012-76914).

For example, in the customer interface when, during a pay-in transaction, the collected banknotes are inserted into the collection space with their length direction running from left to right and their short direction running from top to bottom, the partitioning plate is moved in a specific direction to press the banknotes toward the side of an internally provided feed out mechanism, and the banknotes are separated and passed to the conveyance section one note at a time by the feed out mechanism.

In a pay-out transaction, for example, the customer interface secures the collection space of some size on the side of an internally provided dispensing mechanism by moving the partitioning plate in a specific direction, and the dispensing mechanism dispenses banknotes passed one note at a time from the conveyance section into the collection space, to be collected with their note faces superimposed on each other, and the banknotes are then removed by the user.

SUMMARY OF INVENTION

Technical Problem

In this regard, the size of banknotes handled by an ATM may vary by denomination.

The length of the collection space in the direction corresponding to the banknote length direction (hereafter referred to as the width direction) accordingly needs to be capable of storing banknotes with the longest length in the length direction out of any banknote to be handled.

Banknotes inside the collection space are preferably positioned as close as possible to the width direction center due to the relationship to the positions of rollers incorporated into the feed out mechanism and such like. Namely, the length of the collection space in the width direction is preferably as short as possible.

Namely in the customer interface, the collection space needs to be set to an appropriate length in the width direction, according to the longest length in the length direction of any banknote to be handled.

Accordingly, in the customer interface, the length of the collection space in the width direction is determined by attaching components referred to as side guides in the casing. The length of the collection space in the width direction can be adjusted by changing the attachment positions of the side guides to the casing, or by preparing plural side guides of different sizes, and exchanging the side guides attached to the casing as appropriate.

However, in customer interfaces, when adjusting the length of the collection space in the width direction, some degree of dismantling is required in order to change the attachment positions of the side guides or to exchange the side guides, and sometimes screw fixing and the like is performed from inside the collection space, resulting in poor operation efficiency.

In consideration of the above circumstances, the present invention proposes a medium housing device and a medium processing device enabling easy adjustment of the width of a collection space partitioned by a movable partitioning plate.

Solution to Problem

A medium housing device of one aspect of the present invention includes: a frame internally including an internal space in which a medium is housed; a partitioning plate that partitions the internal space so as to intersect with a specific collection direction, and that forms a collection space in which the medium is collected along the collection direction; a partitioning plate moving section that moves the partitioning plate along the collection direction with respect to the frame; a side guide that is attached inside the frame at a location not interfering with a movement range of the partitioning plate and with the partitioning plate moving section, and that determines the size of the collection space in an intersecting direction intersecting with the collection direction; a positioning portion that is provided at an end portion of the frame in the collection direction, and that positions an end portion of the side guide at one attachment position selected from a plurality of attachment positions; and a retention switching portion that switches between a retained state in which the end portion of the side guide is positioned, and a retention-released state in which the end portion of the side guide is not positioned.

The end portion of the side guide can accordingly be placed in a non-positioned state by simply switching the retention switching portion to the retention-released state. After adjusting the attachment position of the end portion of the side guide, the side guide can be positioned at the adjusted attachment position by switching the retention switching portion back to the retained state.

A medium processing device of another aspect of the present invention includes: a conveyance section that conveys a medium; a frame internally including an internal space in which the medium conveyed in by the conveyance section, or the medium to be conveyed out the conveyance section, is housed; a partitioning plate that partitions the internal space so as to intersect with a specific collection direction, and that forms a collection space in which the medium is collected along the collection direction; a partitioning plate moving section that moves the partitioning plate along the collection direction with respect to the frame; a side guide that is attached inside the frame at a location not interfering with a movement range of the partitioning plate and with the partitioning plate moving section, and that determines the size of the collection space in an intersecting direction intersecting with the collection direction; a positioning portion that is provided at an end portion of the frame in the collection direction, and that positions an end portion of the side guide at one attachment position selected from plural attachment positions; and a retention switching portion that switches between a retained state in which the end portion of the side guide is positioned, and a retention-released state in which the end portion of the side guide is not positioned.

The end portion of the side guide can accordingly be placed in a non-positioned state by simply switching the retention switching portion to the retention-released state. After adjusting the attachment position of the end portion of the side guide, the side guide can be positioned at the adjusted attachment position by switching the retention switching portion back to the retained state.

Effects of Invention

These aspect enable the end portion of the side guide to be placed in a non-positioned state by simply switching the retention switching portion to the retention-released state. After adjusting the attachment position of the end portion of the side guide, the side guide can be positioned at the adjusted attachment position by switching the retention switching portion back to the retained state. These aspects accordingly enable a medium housing device and a medium processing device enabling easy adjustment of the width of a collection space partitioned by a movable partitioning plate.

DESCRIPTION OF EMBODIMENTS

Explanation follows regarding exemplary embodiments, with reference to the drawings.

1. First Exemplary Embodiment

1-1. Overall Configuration of ATM

Figure 1:
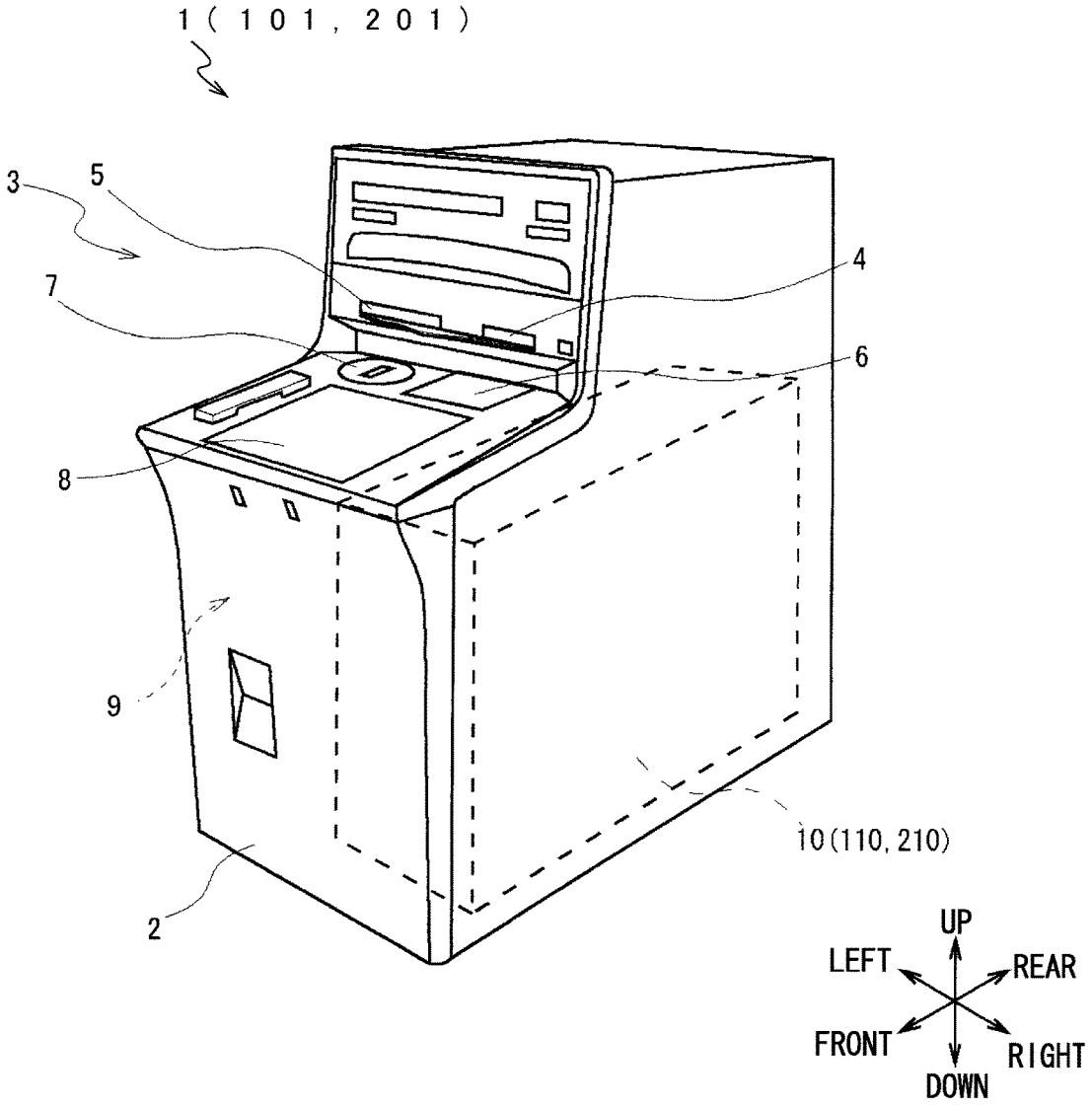
FIG. 1 is a schematic perspective view illustrating an external configuration of an automated teller machine (ATM).

As illustrated in the external view of FIG. 1, an ATM 1 is configured centered on a box shaped casing 2, and is installed in, for example, a financial institution to perform cash transactions such as pay-in transactions and pay-out transactions with a customer (user).

The casing 2 is configured with a partially diagonally cut-away shape at a location enabling easy banknote insertion and easy operation of a touch panel, etc. in a state in which a user faces the front side of the casing 2, namely at a portion spanning from an upper portion of a front face to the top face, with an interaction section 3 provided at this portion.

The interaction section 3 is provided at a front upper portion of the casing 2, and directly handles cash and passbook interactions and the like with the user, as well as notifying transaction-related information and receiving operation instructions.

The interaction section 3 is provided with a card insertion/removal port 4, and a passbook insertion/removal port 5 that face the front, and a banknote pay-in/pay-out port 6, a coin pay-in/pay-out port 7, and a display and operation section 8 that face upwards.

The card insertion/removal port 4 is a section for inserting and dispensing various cards, such as cash cards. A card processor that reads account numbers and the like that are magnetically recorded on various cards is provided inside the card insertion/removal port 4.

The passbook insertion/removal port 5 is a section for inserting and dispensing passbooks. A passbook processor that reads magnetic data recorded in the passbook, prints transaction details, and the like is provided inside the passbook insertion/removal port 5.

The banknote pay-in/pay-out port 6 is a section into which banknotes for paying in are inserted by a user, and where banknotes for paying out to a user are dispensed. The banknote pay-in/pay-out port 6 is opened and closed by driving a shutter, described later.

The coin pay-in/pay-out port 7 is a section into which coins for paying in are inserted by a user, and where coins for paying out to a user are dispensed. Similarly to the banknote pay-in/pay-out port 6, the coin pay-in/pay-out port 7 is opened and closed by driving a shutter.

The display and operation section 8 is a touch panel configured by a Liquid Crystal Display (LCD) that displays operation screens during transactions, integrated with a touch sensor for inputting a transaction type selection, a PIN, a transaction amount, and the like.

In the following explanation of the ATM 1, the front side is defined as the side facing a user, and the opposite side thereto is defined as the rear side. The left side and right side are defined from the perspective of left and right as seen by a user facing the front side, and upper side and lower side are defined as well.

A main controller 9 that performs integrated control of the overall ATM 1, a banknote pay-in/pay-out device 10 that performs various processing relating to banknotes and the like are provided inside the casing 2.

The main controller 9 is configured around a Central Processing Unit (CPU), not illustrated in the drawings. The main controller 9 reads and executes specific programs from ROM, flash memory, or the like, not illustrated in the drawings, to perform various processing in pay-in transactions, pay-out transactions and the like.

Inside the main controller 9 is a storage section configured by, for example, Random Access Memory (RAM), a hard disk drive, and flash memory. The main controller 9 stores various data in the storage section.

The casing 2 is configured with openable doors at portions of side faces, such as on the front face side or rear face side of the casing 2. Namely, as illustrated in FIG. 1, during cash transaction operations with customers (users), the respective doors are closed such that banknotes stored inside the banknote pay-in/pay-out device 10 are protected by the casing 2. However, during a maintenance operation performed by an operator or the like, the respective doors of the casing 2 are opened as required, enabling work on each internal portion to be easily performed.

Figure 2:
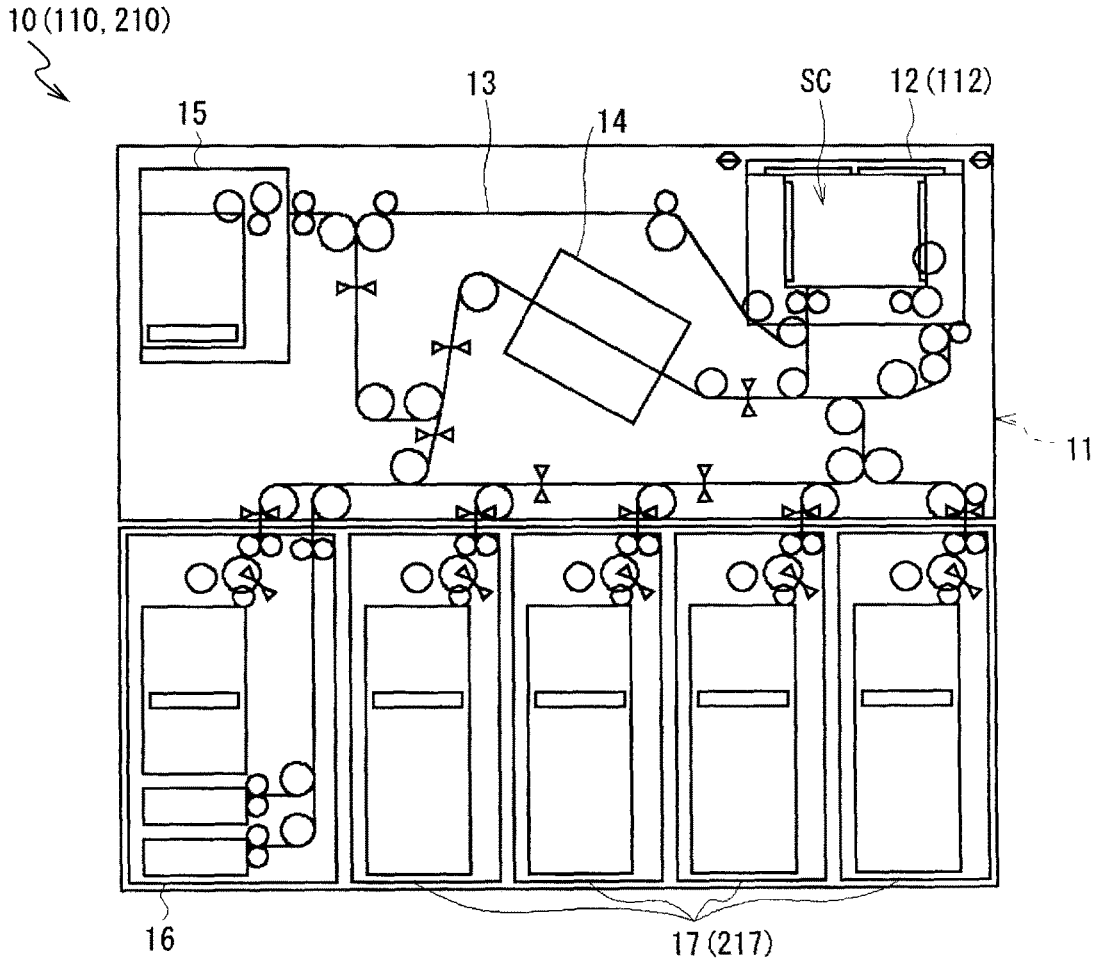
FIG. 2 is a schematic view illustrating configuration of a banknote pay-in/pay-out device.

As illustrated in the side view of FIG. 2, plural sections that perform various processing relating to banknotes are incorporated inside the banknote pay-in/pay-out device 10. Each section of the banknote pay-in/pay-out device 10 is controlled by a banknote controller 11.

The banknote controller 11 is configured around a CPU, not illustrated in the drawings, similarly to the main controller 9. The banknote controller 11 reads and executes specific programs from ROM, flash memory, or the like, not illustrated in the drawings, in order to perform various processing, such as processing to decide the conveyance destination of a banknote.

A storage section configured by RAM, flash memory, or the like is included inside the banknote controller 11, and various data is stored in the storage section.

For example, in a pay-in transaction where a user pays in banknotes, after receiving specific operation input through the display and operation section 8 (FIG. 1), the banknote controller 11 opens the shutter to allow insertion of banknotes into a collection space SC formed inside a customer interface 12.

When the banknotes have been inserted into the collection space SC, the customer interface 12 closes the shutter and takes the banknotes out of the collection space SC one note at a time, passing the banknotes to a conveyance section 13. The conveyance section 13 is configured from plural rollers, belts, and the like, and conveys the banknotes, configured by rectangular shaped sheets of paper, to a classification section 14, with the short edge direction of the banknotes running along the direction of travel.

The classification section 14 classifies the banknotes using optical devices and magnetic detection devices, for example, according to denomination, authenticity, degree of wear and the like, while conveying the banknotes inside the classification section 14, and notifies the classification results to the banknote controller 11. The banknote controller 11 decides the conveyance destination of the banknote based on the acquired classification results.

The conveyance section 13 causes banknotes that the classification section 14 has classified as normal banknotes to be temporarily held by conveying the banknotes to a temporary holding section 15, for example. The conveyance section 13 also conveys reject banknotes, classified as unsuitable for transaction, to the customer interface 12 to be returned to the user.

The banknote controller 11 then prompts the user to approve the pay-in amount using the display and operation section 8, and the conveyance section 13 conveys the banknotes held in the temporary holding section 15 to the classification section 14 for classification according to denomination, degree of wear and the like, and acquires the classification results.

When the degree of wear is heavy, the banknote controller 11 then uses the conveyance section 13 to convey such banknotes to a reject cassette 16 for storage as banknotes that are unsuitable for reuse. When the degree of wear is light, the banknote controller 11 uses the conveyance section 13 to convey such banknotes to be stored by denomination in banknote cassettes 17 as reusable banknotes.

When, for example, a pay-out transaction in which banknotes are paid out to a user is performed, after receiving specific operation input through the display and operation section 8 (FIG. 1), the banknote controller 11 feeds out banknotes according to the amount to be paid out from the banknote cassettes 17, and conveys the banknotes to the classification section 14 using the conveyance section 13.

Next, the banknote controller 11 uses the conveyance section 13 to convey the banknotes to the customer interface 12 after classification by the classification section 14, collects the banknotes inside the collection space SC, and opens the shutter of the banknote pay-in/pay-out port 6 (FIG. 1) to allow removal by the user.

The customer interface 12 is thus configured so as to allow the user to insert banknotes into the collection space SC during a pay-in transaction, and to collect conveyed banknotes in the collection space SC for removal by the user during a pay-out transaction.

1-2. Customer Interface Configuration

Figure 3A:
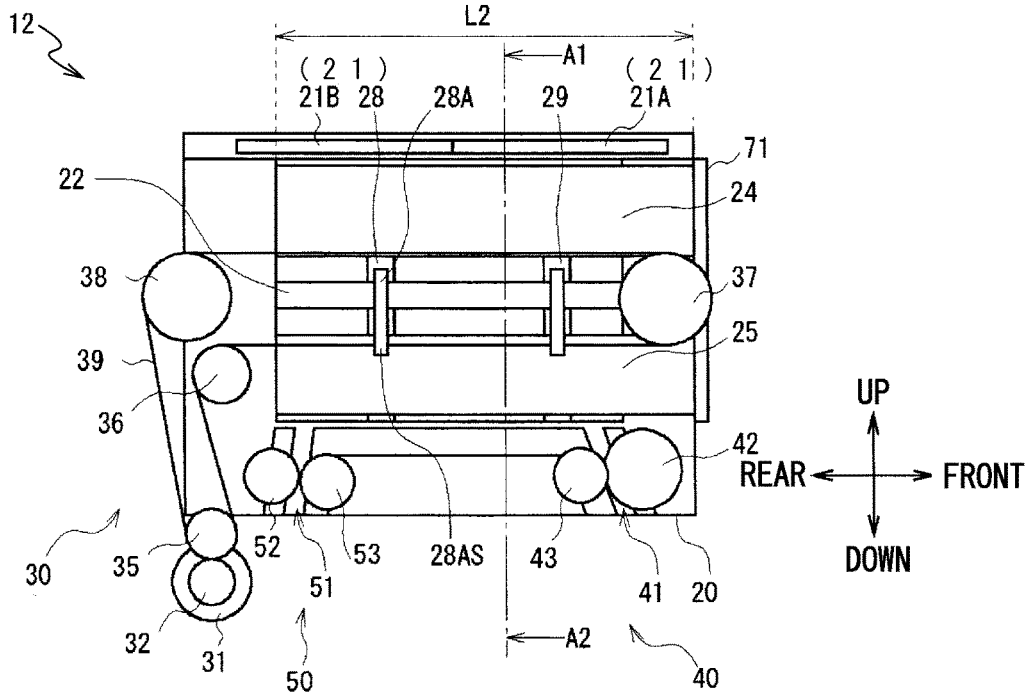
FIG. 3A is a schematic side view from the left, illustrating configuration of a customer interface.
Figure 3B:
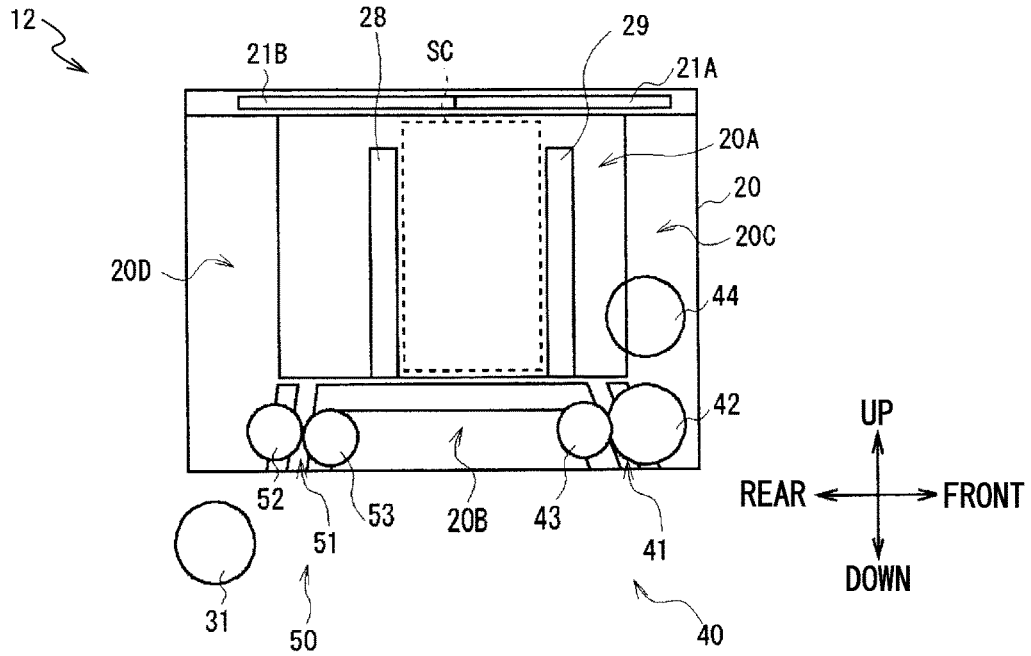
FIG. 3B is a schematic cross-section taken along B1-B2 in FIG. 4, illustrating configuration of the customer interface as viewed from the front.
Figure 4:
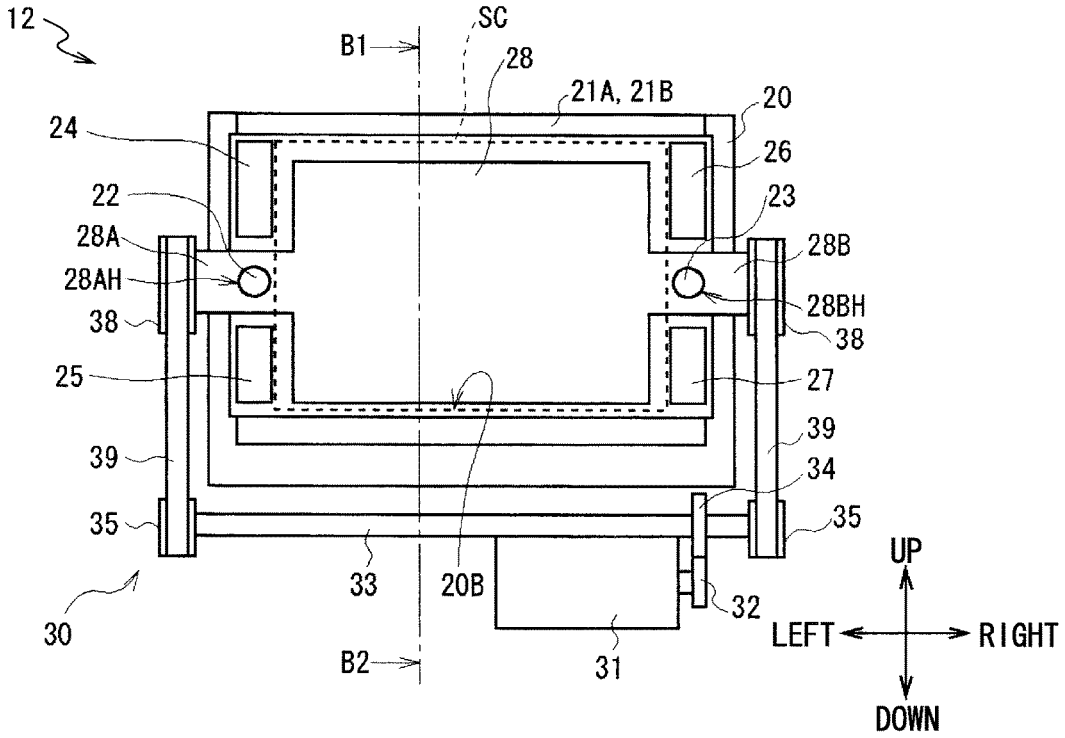
FIG. 4 is schematic cross-section taken along A1-A2 in FIG. 3A, illustrating configuration of the customer interface as viewed from the left.

Explanation follows regarding configuration of the customer interface 12. As illustrated in FIG. 3A, FIG. 3B, and FIG. 4, the customer interface 12 is configured by plural components attached inside a frame 20 configured in an overall rectangular block shape, and the collection space SC for collecting banknotes is formed inside the customer interface 12.

FIG. 3A is a side view of the customer interface 12 as viewed from the left side. FIG. 4 is a cross-section taken along A1-A2 in FIG. 3A, as viewed from the front side. FIG. 3B is a cross-section taken along B1-B2 in FIG. 4, as viewed from the left side. Note that for ease of explanation, the respective components have been simplified, and some components are omitted or shown in a see-through state.

The frame 20 is configured in a rectangular block shape overall, with a rectangular block shaped internal space 20A (FIG. 3B) formed inside the frame 20. A lower side, front side, and rear side of the internal space 20A are respectively enclosed by a lower side portion 20B, a front side portion 20C, and a rear side portion 20D, while the upper side is wide-open so as to be in communication with the outside.

Shutters 21A and 21B, divided into two in the front-rear direction (collectively referred to below as the shutters 21), are provided at the upper side of the frame 20. A drive mechanism, not illustrated in the drawings, slides the respective shutters 21 in the front-rear direction, thereby closing off the internal space 20A from the outside, or opening up the internal space 20A to the outside.

A bill press guide portion 22 is provided in the vicinity of a left end of the internal space 20A, at a height substantially at the top-to-bottom center. The bill press guide portion 22 is formed in a circular columnar shape, and is long and thin in the front-rear direction. Side guides 24 and 25 are respectively provided at the upper side and the lower side of the bill press guide portion 22.

The side guides 24 and 25 are long and thin in the front-rear direction, this being the collection direction, and are formed in rectangular block shapes that are fairly thin in the left-right direction. Namely, the side guides 24 and 25 are configured with front-rear symmetry. A gap of some size is formed between the side guides 24 and 25 and the bill press guide portion 22.

A bill press guide portion 23 and side guides 26 and 27 are provided in the vicinity of a right end of the internal space 20A, and are configured with left-right symmetry to the bill press guide portion 22 and the side guides 24 and 25, respectively.

The side guides 24 to 27 restrict positioning inside the internal space 20A in the left-right direction, serving as an intersecting direction, namely in the banknote width direction (this is described in detail later).

A plate-shaped bill press 28 and a plate-shaped pool guide 29 are provided inside the internal space 20A. The bill press 28, serving as a partitioning plate, is formed in a plate-shape that is thin along the front-rear direction, and partitions the internal space 20A in the front-rear direction.

An upper edge and a lower edge of the bill press 28 respectively form small gaps to a lower face of the shutters 21, and the lower side portion 20B of the frame 20. As illustrated in FIG. 4, the bill press 28 is provided with bill press arm portions 28A and 28B extending toward the outside from the vicinity of the top-to-bottom centers of both left and right side walls.

The bill press arm portion 28A is formed short in the up-down direction, and with small gaps formed between itself and the side guides 24 and 25 respectively. A hole 28AH configured by a circular hole is formed penetrating in the front-rear direction in the vicinity of the top-to-bottom center of the bill press arm portion 28A. The bill press guide portion 22 is inserted through the hole 28AH.

The bill press arm portion 28B is formed with left-right symmetry to the bill press arm portion 28A, and the bill press guide portion 23 is inserted through a hole 28BH corresponding to the hole 28AH.

Namely, the bill press 28 is capable of moving freely in the front-rear direction, by the bill press arm portions 28A and 28B being guided by the bill press guide portions 22 and 23.

The customer interface 12 is provided with a bill press drive section 30 serving as a partitioning plate moving section to drive the bill press 28.

An actuator 31 is installed in the bill press drive section 30, toward the rear and at the lower side of the frame 20. The actuator 31 is provided such that an output shaft thereof faces along the left-right direction. A drive gear 32 is attached to the output shaft. The drive gear 32 enmeshes with a gear 34 inserted through a shaft 33.

The shaft 33 is formed in a long, thin, circular columnar shape, and is disposed with its central axis along the left-right direction, with drive pulleys 35 attached to both ends thereof. The left and right drive pulleys 35 are positioned further to the outside than the side guides 24 to 27.

An idle pulley 36 is provided at a position substantially directly above the drive pulley 35 at a left side face of the frame 20. Idle pulleys 37 and 38 are also provided at the left side of the left side face of the frame 20, in the vicinity of the front end and the rear end of the bill press guide portion 22, namely further to the outside than the side guides 24 and 25.

The attachment position of the idle pulley 37 is adjusted such that the height of a lower end portion of the idle pulley 37 is at substantially the same height as an upper end of the idle pulley 36.

The idle pulleys 36, 37, and 38 are each formed in a circular plate shape with their central axes facing along the left-right direction, and are capable of rotating freely.

A drive belt 39 is entrained between the drive pulley 35 and the idle pulleys 36, 37, and 38. The drive belt 39 contacts each of the pulleys, at a lower side of the drive pulley 35, at a rear upper side of the idle pulley 36, at a front side of the idle pulley 37, and at a rear upper side of the idle pulley 38.

The drive belt 39 is substantially parallel to the bill press guide portion 22 where it spans between the idle pulleys 36 and 37, and a belt fixing portion 28AS of the bill press arm portion 28A is fixed at this location.

Idle pulleys 36, 37, and 38, and a drive belt 39, are provided at the right side face of the frame 20, similarly to at the left side face.

When the actuator 31 is supplied with power, the thus configured bill press drive section 30 rotates the drive gear 32, thereby rotating the drive pulleys 35 through the gear 34. The bill press drive section 30 accordingly circulates the drive belt 39 between the drive pulleys 35 and the idle pulleys 36, 37, and 38, enabling the bill press 28 that is fixed to the drive belt 39 to be moved in the front-rear direction.

The pool guide 29 is configured in a plate shape, similarly to the bill press 28, and is configured so as to be capable of moving freely in the front-rear direction along the bill press guide portions 22 and 23, further to the front than the bill press 28.

The pool guide 29 moves in the front-rear direction due to drive force transmitted from a pool guide drive section, not illustrated in the drawings.

As illustrated by the intermittent line in FIG. 3B and FIG. 4, a space is formed inside the internal space 20A, enclosed by the shutters 21 and the lower side portion 20B of the frame 20 to the top and bottom, enclosed by the pool guide 29 and the bill press 28 to the front and rear, and enclosed by the side guides 24 to 27 to the left and right. This space is referred to below as the collection space SC.

Namely, the length of the collection space SC in the left-right direction is determined according to the attachment positions of the side guides 24 to 27 to the frame 20.

Banknotes are collected in the collection space SC in a state in which the faces of the notes face toward the front and rear, and the length direction of the banknotes is orientated from left to right. The attachment positions of the side guides 24 to 27 are therefore determined according to the longest length in the length direction of any banknote that will be housed in the collection space SC.

A feed-out section 40 that passes banknotes BL inside the collection space to the conveyance section 13 (FIG. 2), and a collection section 50 that collects banknotes BL that have been conveyed up from the conveyance section 13 inside the collection space, are incorporated at a lower portion of the frame 20.

The feed-out section 40 is configured by a feed-out roller 42 and a following roller 43 disposed to the front and rear of a conveyance path 41 running in the up-down direction, and a picker roller 44 disposed toward the bottom of the front side portion 20C of the frame 20.

The conveyance path 41 is formed passing through the frame 20 from top to bottom, and is capable of passing banknotes BL through in the downward direction.

The feed-out roller 42 faces the following roller 43 across the conveyance path 41, and rotates in a counterclockwise direction as viewed from the left side under drive force transmitted from a drive mechanism, not illustrated in the drawings.

The following roller 43 abuts the feed-out roller 42, and rotates in a clockwise direction as viewed from the left side accompanying rotation of the feed-out roller 42.

A rear side portion of the picker roller 44 projects out into the internal space 20A, and, similarly to the feed-out roller 42, rotates in a counterclockwise direction as viewed from the left side under drive force transmitted from the drive mechanism, not illustrated in the drawings. The pool guide 29 is provided with a hole to expose the rear side of the picker roller 44.

The collection section 50 is configured by a collection roller 52 and a following roller 53 that are disposed to the front and rear of a conveyance path 51 formed along the up-down direction.

The conveyance path 51 is formed passing through the frame 20 from top to bottom, and is capable of passing banknotes BL through in the upward direction.

The collection roller 52 faces the following roller 53 across the conveyance path 51, and rotates in a counter-clockwise direction as viewed from the left side under drive force transmitted from a drive mechanism, not illustrated in the drawings.

The following roller 53 abuts the collection roller 52, and rotates in a clockwise direction as viewed from the left side accompanying rotation of the collection roller 52.

Figure 5:
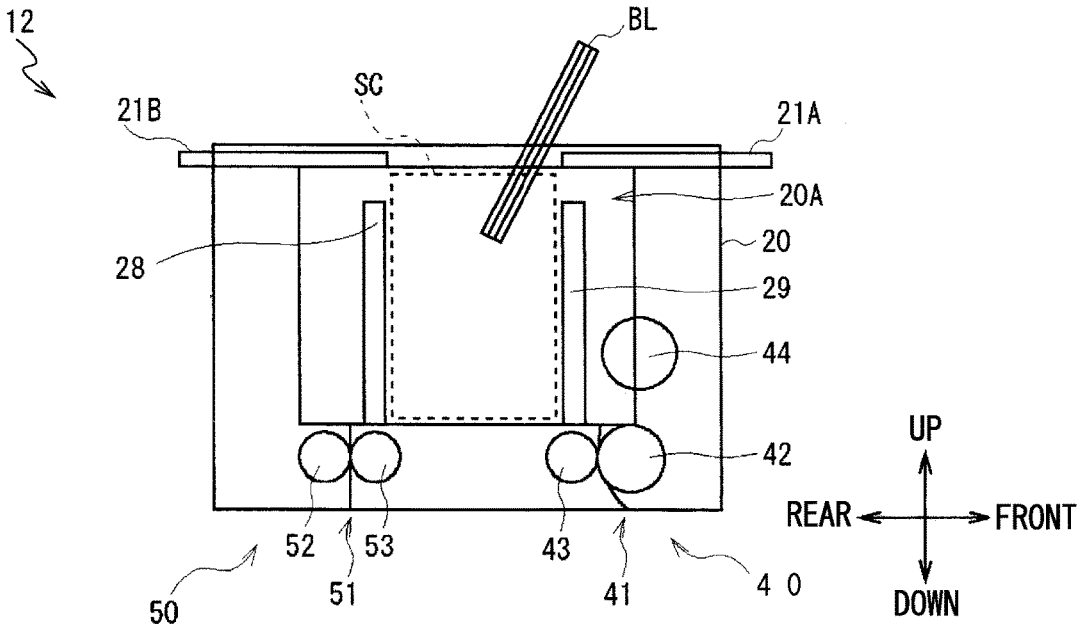
FIG. 5 is a schematic view illustrating banknote exchange in the customer interface.

In the customer interface 12 configured in this manner, for example, when a user pays in banknotes BL, serving as a medium, during a pay-in transaction, as illustrated in FIG. 5, the bill press 28 is positioned further to the front side than the conveyance path 51, the pool guide 29 is positioned further to the rear side than the conveyance path 41, and the shutters 21 are opened to place the collection space SC in communication with the space outside.

The customer interface 12 accordingly enables the insertion of banknotes BL into the collection space SC by the user. The inserted banknotes BL at this time are in a state in which a long edge of the banknotes BL abuts the lower side portion 20B of the frame 20 inside the collection space SC, and the length direction of the banknotes BL runs substantially in the left-right direction, with the banknotes BL in an upright state leaning against either the bill press 28 or the pool guide 29.

Figure 6:
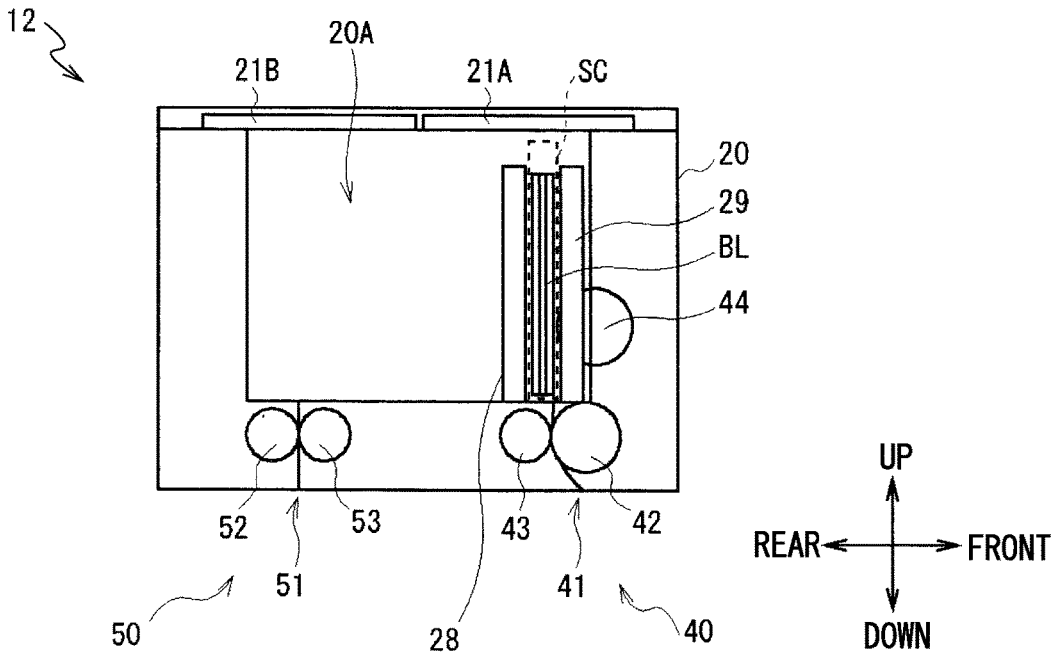
FIG. 6 is a schematic view illustrating banknote feed-out in the customer interface.

Next, as illustrated in FIG. 6, the customer interface 12 closes the shutters 21 and moves the pool guide 29 to the frontmost side, and moves the bill press 28 furthermost to the front side so as to press the banknotes BL against the pool guide 29.

In this state, the customer interface 12 rotates the picker roller 44 of the feed-out section 40 to feed the banknotes BL out downward in sequence. The feed-out roller 42 and the following roller 43 convey the banknotes BL in sequence downward along the conveyance path 41, and pass the banknotes BL to the conveyance section 13 (FIG. 2).

Figure 7:
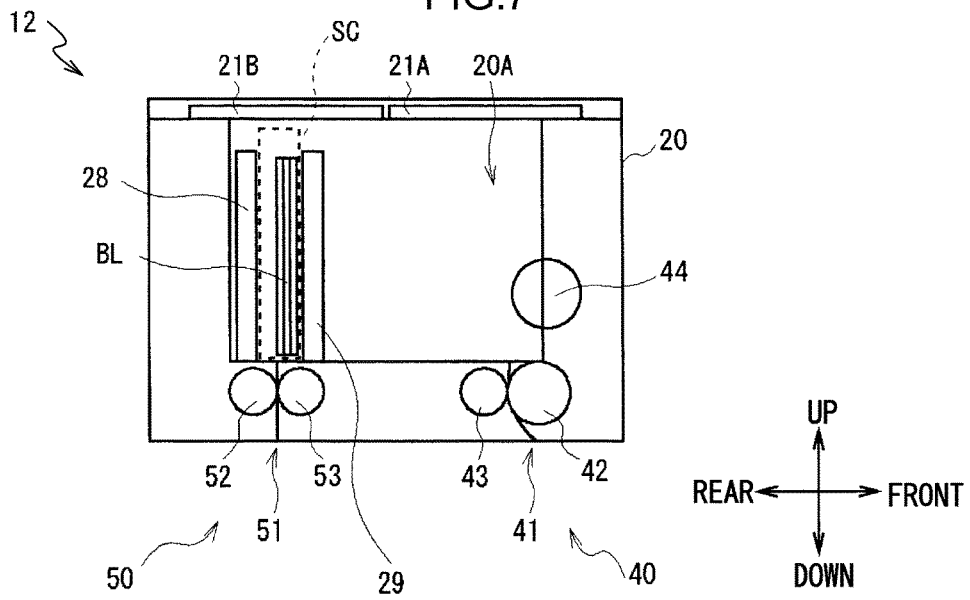
FIG. 7 is a schematic view illustrating banknote collection in the customer interface.

In the customer interface 12, for example, when banknotes BL are paid out to the user in a pay-out transaction, as illustrated in FIG. 7, the bill press 28 is moved to the rearmost side and the pool guide 29 is positioned slightly to the front of the conveyance path 51, thereby forming the collection space SC at a portion toward the rear of the internal space 20A.

In this state, the customer interface 12 rotates the collection roller 52 and the following roller 53 to convey banknotes BL passed in sequence from the conveyance section 13 (FIG. 2) upward in sequence along the conveyance path 51, collecting the banknotes BL in the collection space SC. When this is performed, the customer interface 12 gradually moves the pool guide 29 toward the front as the collected banknotes BL increase, thereby gradually enlarging the collection space SC.

Then, once all of the banknotes BL to be paid out have been collected in the collection space SC, the customer interface 12 moves the pool guide 29 and the bill press 28 toward the front, up to the positions illustrated in FIG. 5, and then opens the shutters 21 to place the collection space SC in communication with the space outside, enabling removal of the banknotes BL by the user.

In this manner, the customer interface 12 exchanges banknotes BL0 with the user while housing banknotes BL in the collection space SC, whose size in the left-right direction is determined by the side guides 24 to 27.

1-3. Side Guide Attachment

Explanation follows regarding attachment of the side guides 24 to 27 (FIGS. 3A and 3B, FIG. 4) to the frame 20 of the customer interface 12.

Figure 8A:
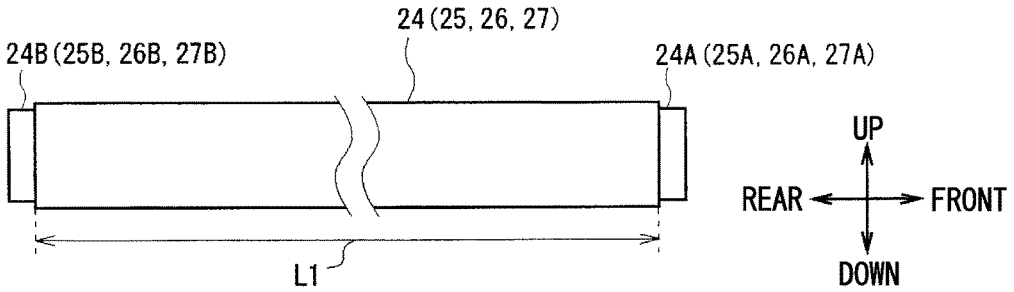
FIG. 8A is a schematic side view from the left, illustrating configuration of a side guide in a first exemplary embodiment.
Figure 8B:
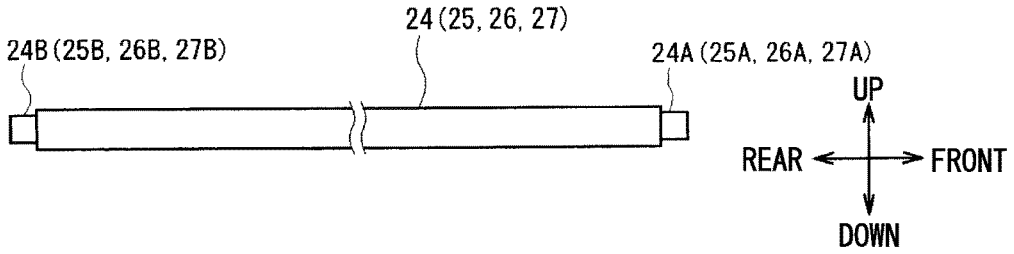
FIG. 8B is a schematic plan view, illustrating configuration of the side guide in the first exemplary embodiment.

As illustrated in FIG. 8A and FIG. 8B, an engagement projection 24A, serving as an engagement portion, is provided at a front end of the side guide 24 so as to project out toward the front. The engagement projection 24A is formed in a rectangular block shape slightly thinner than the side guide 24. An engagement projection 24B with front-rear symmetry to the engagement projection 24A is provided at a rear end of the side guide 24 so as to project out toward the rear.

Similarly to the side guide 24, engagement projections 25A, 26A, and 27A are also provided projecting out at the front ends, and engagement projections 25B, 26B, and 27B are provided projecting out at the rear ends of the respective side guides 25, 26 and 27.

A length L1, this being the length of the side guides 24 to 27 in the front-rear direction, is substantially the same as a length L2 (FIG. 3A) from the front face of the rear side portion 20D to the front face of the front side portion 20C of the frame 20.

Figure 9:
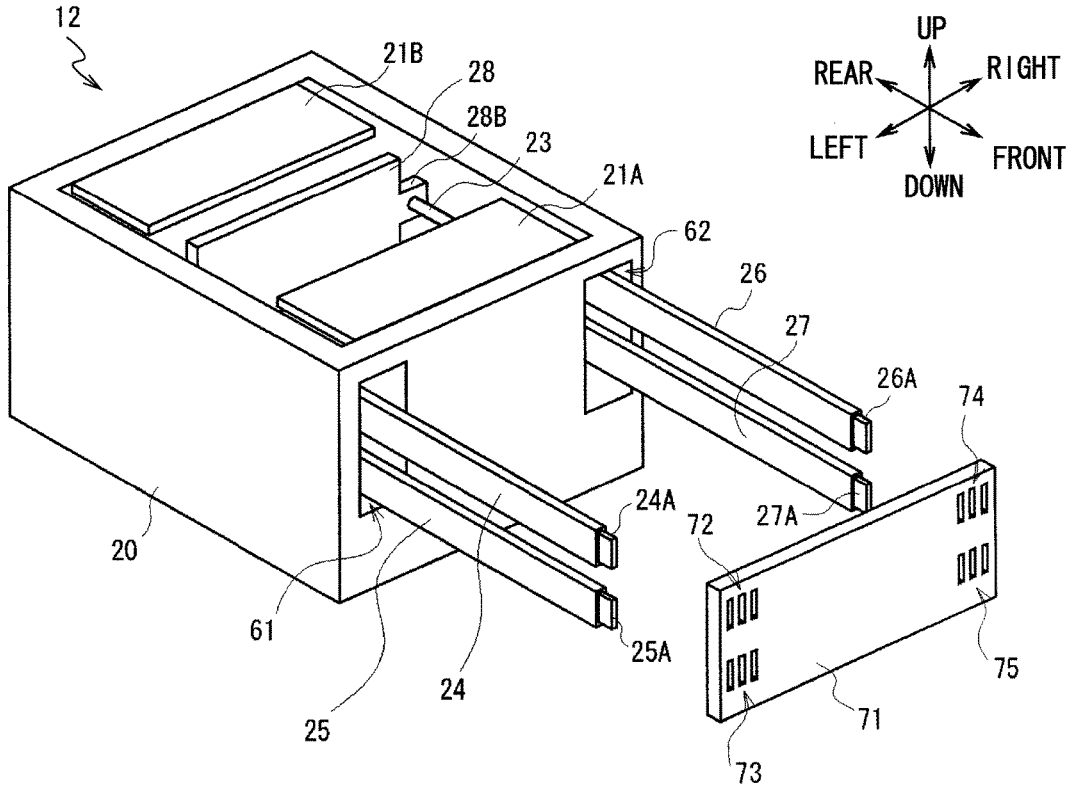
FIG. 9 is a schematic perspective view illustrating attachment of the side guides in the first exemplary embodiment.

As illustrated in FIG. 9, the front side portion 20C of the frame 20 is provided with insertion holes 61 and 62 at the left and right, penetrating through in the front-rear direction.

The insertion hole 61 is positioned at a location to the front of the side guides 24 and 25, and is formed sufficiently larger than the cross-section shape of the side guides 24 and 25. The respective side guides 24 and 25 can accordingly be inserted through the insertion hole 61 into the internal space 20A from the front outside of the frame 20.

Similarly, the insertion hole 62 is positioned at a location to the front of the side guides 26 and 27, and the respective side guides 26 and 27 can be inserted into the internal space 20A from outside the front of the frame 20.

Figure 10:
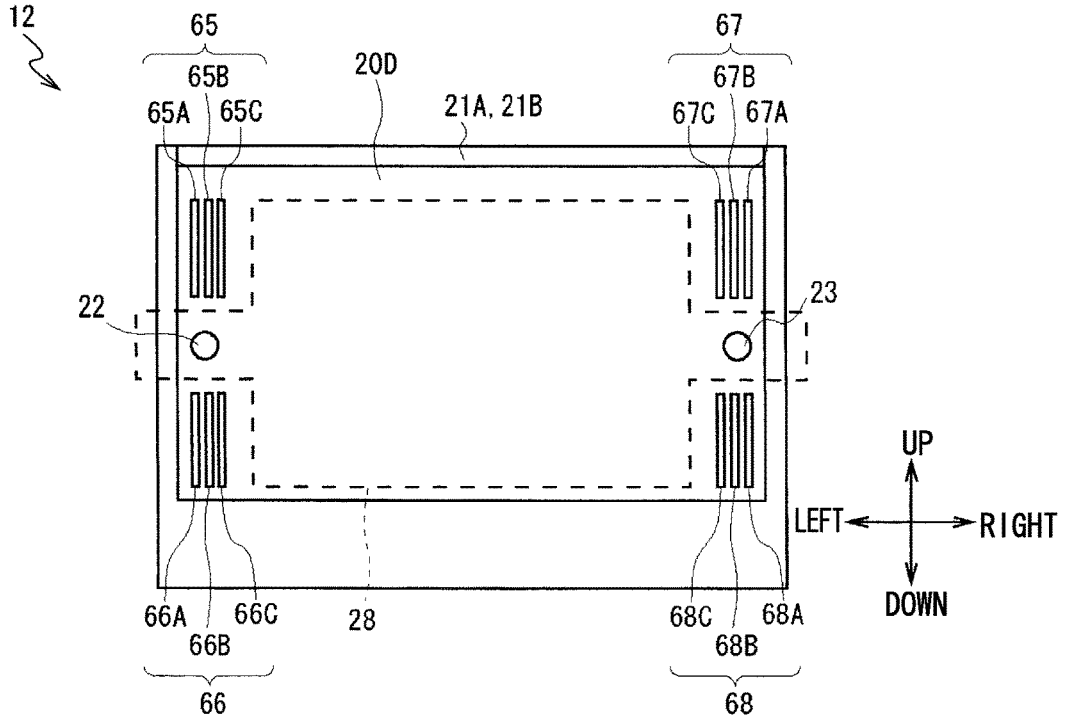
FIG. 10 is a schematic view illustrating configuration of a rear side portion of a frame.

As illustrated in FIG. 10, corresponding to FIG. 4, engagement hole groups 65, 66, 67, and 68, serving as positioning portions and engaged-with portions, are provided at the upper left, lower left, upper right, and lower right of the front face side (namely an inner face side) of the rear side portion 20D of the frame 20.

The engagement hole group 65 is configured by engagement holes 65A, 65B, and 65C at three locations. The engagement hole 65A has a rectangular shape that is long and thin in the up-down direction, and is formed slightly larger than the engagement projection 24B (FIG. 8) of the side guide 24.

The engagement holes 65B and 65C are each formed in a rectangular shape similar to that of the engagement hole 65A, and are disposed at a specific separation to each other at the right side of the engagement hole 65A. Namely, the engagement holes 65A, 65B, and 65C are arranged in a row at specific separations to each other along the left-right direction.

Accordingly, the side guide 24 (FIG. 8A and FIG. 8B) is inserted inside the frame 20 through the insertion hole 61, and the engagement projection 24B is inserted through any one of the engagement holes 65A, 65B, and 65C, placing the engagement projection 24B in an engaged state such that the rear end of the side guide 24 is positioned by the engagement hole group 65.

Namely, the engagement hole group 65 engages with the engagement projection 24B at one of the engagement holes 65A, 65B, and 65C selected by an operator, enabling the position of the rear end of the side guide 24 to be adjusted in the left-right direction.

The engagement hole group 66 is configured similarly to the engagement hole group 65, with engagement holes 66A, 66B, and 66C arranged in a row at three locations, at specific separations to each other along the left-right direction. The engagement hole groups 67 and 68 are formed with left-right symmetry to the respective engagement hole groups 65 and 66, with engagement holes 67A, 67B, and 67C at three locations and engagement holes 68A, 68B, and 68C at three locations respectively arranged in rows at specific separations to each other along the left-right direction.

Namely, by engaging the engagement projections 25B, 26B, 27B with respective engagement holes selected by the operator, the engagement hole groups 66, 67, and 68 enable the position of the rear end of the side guides 25, 26, and 27 to be adjusted in the left-right direction, similarly to the engagement hole group 65.

As illustrated in FIG. 9, a cover plate 71 is attached to a front side of the front side portion 20C of the frame 20. The cover plate 71 can be easily attached and detached from the front side portion 20C of the frame 20 using attachment screws, not illustrated in the drawings.

Figure 11:
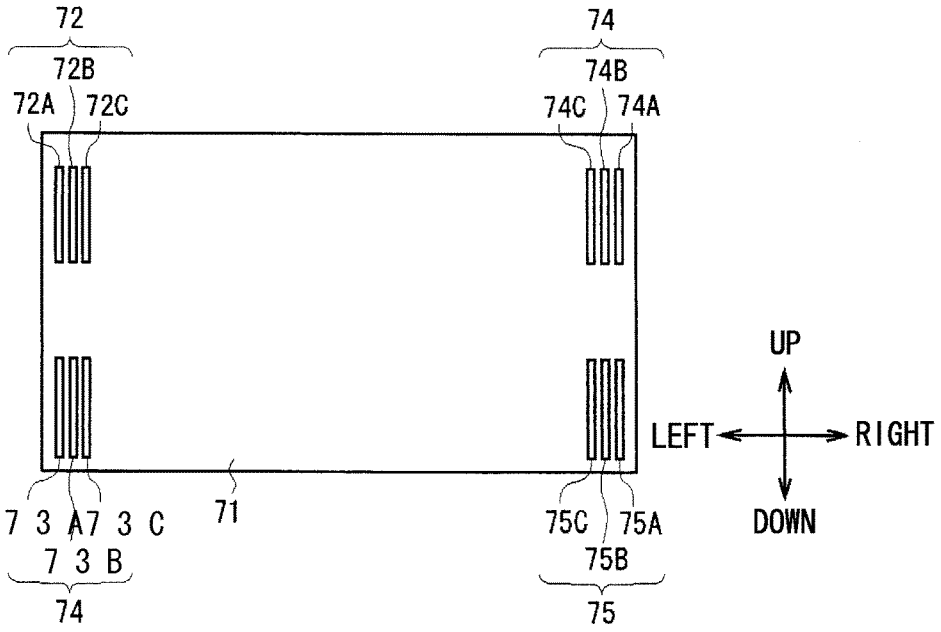
FIG. 11 is a schematic view illustrating configuration of a cover plate.

As illustrated in FIG. 11, the cover plate 71 that serves as a retention switching portion and a detachable portion is provided with engagement hole groups 72, 73, 74, and 75, respectively serving as positioning portions and engaged-with portions, at locations that are at the upper left, lower left, upper right, and lower right when the cover plate 71 is attached to the front side portion 20C of the frame 20.

The engagement hole group 72 is configured at three locations by engagement holes 72A, 72B, and 72C, similarly to the engagement hole group 65 formed in the rear side portion 20D. The engagement holes 72A, 72B, and 72C are each formed in a rectangular shape that is long and thin along the up-down direction, and is formed slightly larger than the engagement projection 24A (FIG. 8A and FIG. 8B) of the side guide 24. The engagement holes 72A, 72B, and 72C are arranged in a row at specific separations to each other along the left-right direction. These separations are matched with the separations of the engagement hole group 65.

Accordingly, when the side guide 24 (FIG. 9) is inserted inside the frame 20 through the insertion hole 61, and the cover plate 71 is attached to the front side portion 20C in a state in which the engagement projection 24A faces any one of the engagement holes 72A, 72B, and 72C, the engagement projection 24A is placed in an engaged state such that the front end side of the side guide 24 is positioned by the engagement hole group 72.

Namely, by engaging the engagement projection 24A with one of the engagement holes 72A, 72B, and 72C selected by the operator, the engagement hole group 72 enables the position of the front end of the side guide 24 to be adjusted in the left-right direction when attaching the cover plate 71 to the front side portion 20C.

The engagement hole group 73 is configured similarly to the engagement hole group 72, with engagement holes 73A, 73B, and 73C at three locations arranged in a row at specific separations to each other along the left-right direction. The engagement hole groups 74 and 75 are formed with left-right symmetry to the respective engagement hole groups 72 and 73, with engagement holes 74A, 74B, and 74C at three locations and engagement holes 75A, 75B, and 75C at three locations respectively arranged in rows at specific separations to each other along the left-right direction.

Similarly to the engagement hole group 72, by engaging the engagement projections 25A, 26A, and 27A with respective engagement holes selected by the operator, the engagement hole groups 73, 74, and 75 enable the position of the front end of the side guides 25, 26, 27 to be adjusted in the left-right direction when attaching the cover plate 71 to the front side portion 20C.

By engaging the respective engagement projections 24B to 27B and 24A to 27A at the front and rear of the side guides 24 to 27 with the respective engagement holes provided at three locations each at the engagement hole groups 65 to 68 and 72 to 75 in this manner in the customer interface 12, the positions of the side guides 24 to 27 can be adjusted in the left-right direction.

1-4. Operation and Effects

In the customer interface 12 of the first exemplary embodiment configured as described above, the engagement projections 24A to 27A and 24B to 27B are respectively provided at the front ends and the rear ends of the side guides 24 to 27.

In the frame 20 of the customer interface 12, the front side portion 20C is provided with the respective insertion holes 61 and 62, and the front face of the rear side portion 20D is provided with the engagement hole groups 65 to 68, in which the engagement holes 65A to 65C and the like are respectively provided at three locations, arranged in rows along the left-right direction.

Moreover, the cover plate 71 is provided with the engagement hole groups 72 to 75 in which the engagement holes 72A to 72C and the like are respectively provided at three locations, arranged in rows along the left-right direction.

During the manufacturing processes of the customer interface 12, in an assembled state to the frame 20 of the bill press guide portions 22 and 23 (FIG. 3A, FIG. 3B, and FIG. 4), the bill press 28, the bill press drive section 30 and so on, the side guides 24 and 25 are inserted through the insertion hole 61 of the front side portion 20C, and the side guides 26 and 27 are inserted through the insertion hole 62 (FIG. 9).

When this is performed, among the three engagement holes provided in each of the engagement hole groups 65 to 68, an operator or the like engages the engagement projections 24B to 27B respectively provided to the rear ends of the side guides 24 to 27 with the respective engagement holes corresponding to the length direction length of the banknotes BL to be handled.

Next, in the customer interface 12, the cover plate 71 is attached to the front side portion 20C of the frame 20. When this is performed, among the three engagement holes provided in each of the engagement hole groups 72 to 75, the operator or the like engages the engagement projections 24A to 27A provided to the respective front ends of the side guides 24 to 27 with the respective engagement holes corresponding to the length direction length of the banknotes BL to be handled.

For example, the engagement projections 24A and 24B in the side guide 24 are respectively engaged with the engagement hole 65A and the engagement hole 72A selected by the operator.

The side guide 24 can accordingly be adjusted such that the separation to the side guide 26, namely the length of the collection space SC in the left-right direction, is slightly longer than the longest length in the length direction of any banknote BL to be handled.

Accordingly, during the manufacturing process of the customer interface 12, the positions of the side guides 24 to 27 in the left-right direction can be easily adjusted, and the size of the collection space SC in the width direction can be easily varied, simply by engaging the respective engagement projections 24B to 27B and 24A to 27A of the side guides 24 to 27 with the selected engagement holes in the engagement hole groups 65 to 68 and 72 to 75.

In conventional customer interfaces, for example, plural screw holes are provided at an inner face of a frame 20, and configuration is made in which side guides 24 to 27 are respectively aligned with desired positions and fixed using screws from the side of the internal space 20A. Such a screw fixing operation from the side of the internal space 20A is difficult for the operator to perform, resulting in poor work efficiency.

However, in the customer interface 12 of the present exemplary embodiment, the front ends and the rear ends of the side guides 24 to 27 can be positioned with respect to the frame 20 simply by attaching the cover plate 71 to the frame 20 from the outside, while placing the side guides 24 to 27 in a state sandwiched between the cover plate 71 and the rear side portion 20D of the frame 20. This thereby enables work efficiency to be greatly improved in comparison to conventional customer interfaces.

Further, after manufacture of the customer interface 12, the side guides 24 to 27 can be removed from the insertion holes 61 and 62 without a labor-intensive dismantling operation, by simply removing the cover plate 71 from the frame 20. The engagement holes with which the respective engagement projections are engaged can accordingly be changed.

Accordingly, in the customer interface 12, even when the length of the collection space SC in the left-right direction is changed after manufacture, the engaged state between the respective engagement projections of the side guides 24 to 27 and the respective engagement holes of the respective engagement hole groups can be released by the very simple operation of removing the cover plate 71 from the front side portion 20C of the frame 20, and the attachment positions can be easily changed.

The insertion holes 61 and 62 are formed relatively large, thereby enabling the side guides 24 to 27 to move freely in left-right direction in an inserted state.

Accordingly, in the customer interface 12, the positions of the side guides 24 to 27 in the left-right direction can be adjusted by simply pulling the side guides 24 to 27 out toward the front just far enough that the engagement projections 24A to 27A come out of the respective engagement holes of the engagement hole groups 65 to 68, without completely removing the side guides 24 to 27 from the frame 20.

Moreover, in the customer interface 12, the side guides 24 to 27 are shaped with front-rear symmetry, and the engagement projections 24A to 27A and 24B to 27B have substantially the same shape as each other. In addition, in the customer interface 12, the respective engagement holes of the engagement hole groups 65 to 68 and the respective engagement holes of the engagement hole groups 72 to 75 have substantially the same shape as each other.

Accordingly, the side guides 24 to 27 can be attached to the frame 20 in the customer interface 12, even if they are reversed in the front-rear direction. The operator therefore does not have to pay attention to the front-rear directions of the side guides 24 to 27 during an attachment operation or position adjustment operation of the side guides 24 to 27, it being sufficient to make sure that the length direction of the side guides 24 to 27 is along the front-rear direction.

Due to the above configuration, during assembly of the customer interface 12 of the first exemplary embodiment, the operator may engage the engagement projections 24B to 27B of the side guides 24 to 27 with the selected engagement holes from the engagement hole groups 65 to 68, and may attach the cover plate 71 to the front side portion 20C of the frame 20 while engaging the engagement projections 24A to 27A with the selected engagement holes from the engagement hole groups 72 to 75. The customer interface 12 accordingly enables easy adjustment of the attachment positions of the side guides 24 to 27 by a simple operation from the outside of the frame 20, without the need for any major dismantling after assembly.

2. Second Exemplary Embodiment

An ATM 101 (FIG. 1) according to a second exemplary embodiment differs from the ATM 1 of the first exemplary embodiment in that a banknote pay-in/pay-out device 110 is included instead of the banknote pay-in/pay-out device 10, with other portions thereof are configured similarly.

Although the banknote pay-in/pay-out device 110 (FIG. 2) differs from the banknote pay-in/pay-out device 10 according to the first exemplary embodiment in that a customer interface 112 is included instead of the customer interface 12, other portions thereof are configured similarly.

2-1. Customer Interface Configuration

The customer interface 112 differs from the customer interface 12 of the first exemplary embodiment in the points that it is configured centered on a frame 120 in place of the frame 20, includes side guides 124, 125, 126, and 127 in place of the side guides 24, 25, 26, and 27, and the cover plate 71 is omitted.

Figure 12:
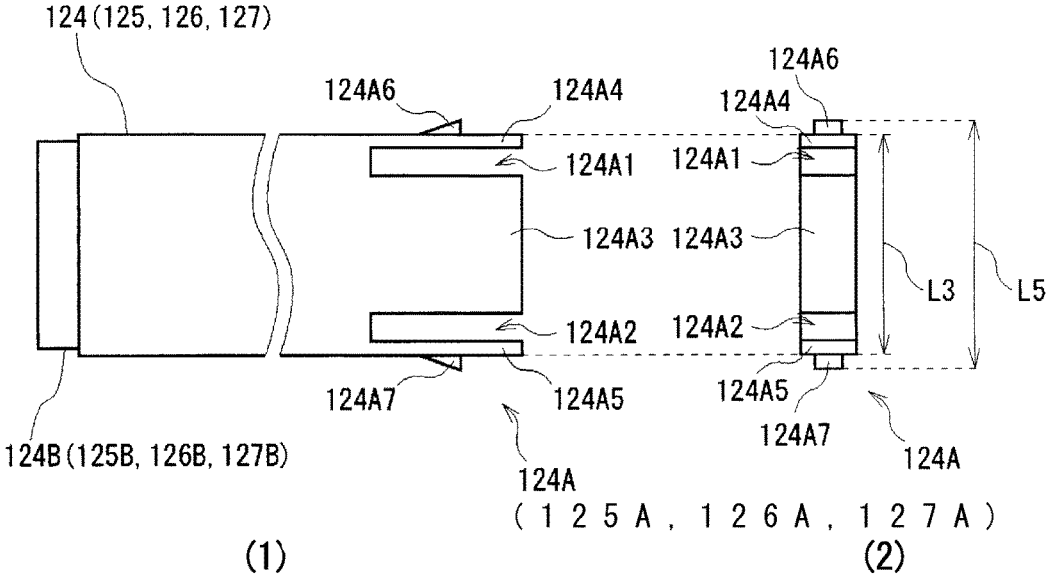
FIG. 12 is a schematic view illustrating configuration of a side guide in a second exemplary embodiment.

As illustrated in FIG. 12, partially corresponding to FIG. 8A and FIG. 8B, a rear end portion of the side guide 124 includes an engagement projection 124B corresponding to the engagement projection 24B; however, a front end portion of the side guide 124 is formed with an engagement portion 124A that differs greatly from the engagement projection 24A. The side guide 124 is configured from a specific resin material.

The engagement portion 124A is divided into a central portion 124A3 at the center, a plate-shaped portion 124A4 at an upper end, and a plate-shaped portion 124A5 at a lower end, by groove portions 124A1 and 124A2 formed deeply from a front end side toward the rear in the vicinity of an upper end and in the vicinity of a lower end of the engagement portion 124A.

The plate-shaped portions 124A4 and 124A5 are both formed in a plate-shape that is thin in the up-down direction, and long in the front-rear direction. Rear side ends of the plate-shaped portions 124A4 and 124A5 are connected to a main body of the side guide 124, with spaces formed above and below. The plate-shaped portions 124A4 and 124A5 accordingly undergo resilient deformation when applied with external force in the up-down direction.

A claw portion 124A6 projects upward from an upper face of the plate-shaped portion 124A4 at a location a specific distance from the front end. A rear side of the claw portion 124A6 is formed with an inclined face facing diagonally upward, and a front side of the claw portion 124A6 is formed with a vertical face facing substantially toward the front direction.

A claw portion 124A7, formed with substantially top to bottom symmetry to the claw portion 124A6, projects downward from a lower face of the plate-shaped portion 124A5 at a location a specific distance from the front end.

The side guides 125, 126, and 127 each have a configuration similar to the side guide 124, and respectively include engagement portions 125A, 126A, and 127A configured similarly to the engagement portion 124A.

Figure 13:
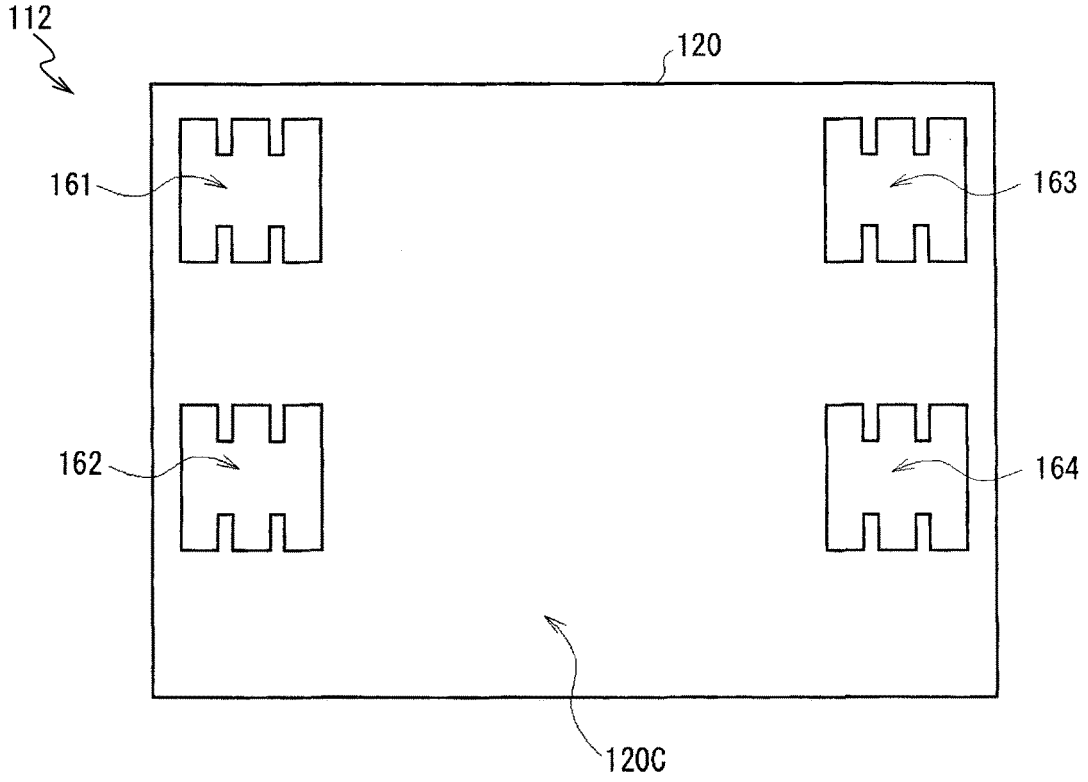
FIG. 13 is a schematic view illustrating a configuration of a front side portion of a frame in the second exemplary embodiment.

As illustrated in FIG. 13, in place of the insertion holes 61 and 62, insertion holes 161, 162, 163, and 164 are provided in a front side portion 120C of the frame 120, corresponding to the front side portion 20C.

Figure 14:
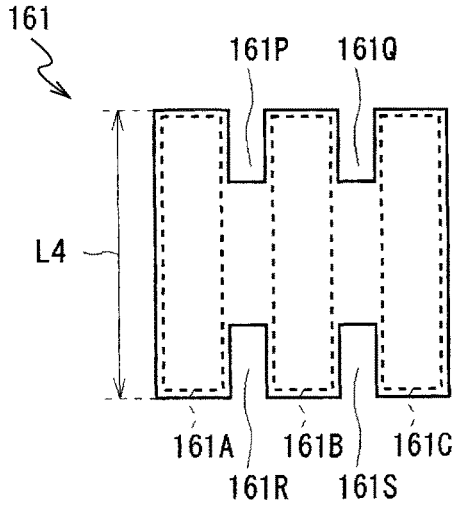
FIG. 14 is a schematic view illustrating configuration of an insertion hole in the second exemplary embodiment.

As illustrated in FIG. 14, the insertion hole 161 is formed with a shape in which three regions 161A, 161B, and 161C that are long and thin in the up-down direction are coupled together along the left-right direction.

The regions 161A, 161B, and 161C are partitioned from each other by partitioning portions 161P and 161Q provided projecting downward from an upper edge of the insertion hole 161, and partitioning portions 161R and 161S provided projecting upward from a lower edge of the insertion hole 161.

The regions 161A, 161B, and 161C are formed substantially the same size, or slightly larger than, a projected profile ((2) in FIG. 12) of the side guide 124 as viewed from the front.

For example, a length L4 of the insertion hole 161 in the up-down direction is slightly greater (longer) than a length L3 of the main body of the side guide 124 (FIG. 12) in the up-down direction. The length L4 is also smaller (shorter) than a length L5 of the side guide 124 from an upper end of the claw portion 124A6 to a lower end of the claw portion 124A7.

The insertion holes 162, 163, and 164 each have substantially the same configuration as the insertion hole 161.

In the customer interface 112, the engagement portions 124A to 127A are formed to the side guides 124 to 127, and the front side portion 120C is provided with the insertion holes 161 to 164.

2-2. Operation and Effects

In the above configuration, in the customer interface 112 according to the second exemplary embodiment, the insertion holes 161 to 164, each including plural mutually partitioned regions, are formed at the front side portion 120C of the frame 120 (FIG. 13, FIG. 14).

The engagement projections 124B to 127B are provided to the rear ends of the respective side guides 124 to 127, similarly to in the first exemplary embodiment, and the engagement portions 124A to 127A are provided at the front ends of the respective side guides 124 to 127.

In this customer interface 112, for example, during attachment of the side guide 124 to the frame 120, the side guide 124 is inserted through the insertion hole 161 of the front side portion 120C from the front of the frame 120.

Figure 15:
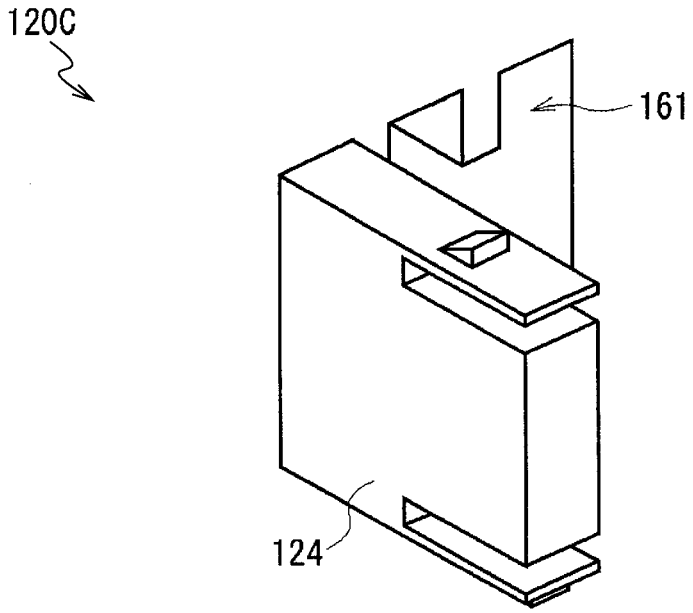
FIG. 15 is a schematic perspective view illustrating insertion of the side guide in the second exemplary embodiment.

As illustrated in FIG. 15, after selecting one of the regions 161A to 161C of the insertion hole 161 (for example, the region 161A), the side guide 124 is then inserted through this region 161A.

When the side guide 124 is inserted through the region 161A (FIG. 14), the position of the side guide 124 in the up-down direction is restricted by the upper edge and the lower edge of the insertion hole 161, and the position of the side guide 124 in the left-right direction is restricted by the partitioning portions 161P and 161R, thereby fixing the insertion location of the side guide 124 in the insertion hole 161 at the region 161A. In other words, the attachment position of the front side of the side guide 124 is temporarily fixed simply by inserting into the selected region of the insertion hole 161.

Figure 16A:
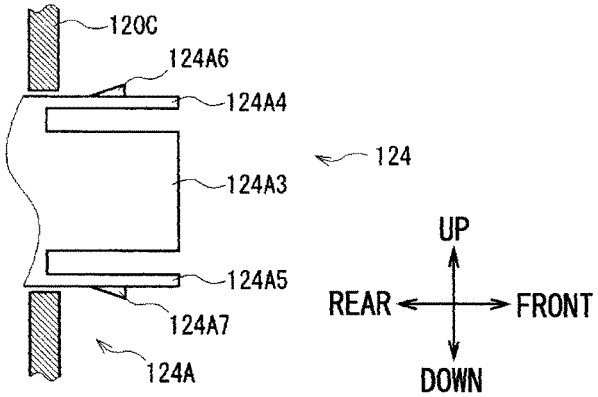
FIG. 16A is a schematic view illustrating engagement between a front side portion and an engagement portion in the second exemplary embodiment.

The engagement portion 124A reaches the vicinity of the front side portion 120C by progressively inserting the side guide 124 inside the frame 120, as illustrated in the cross-section of FIG. 16A.

Figure 16B:
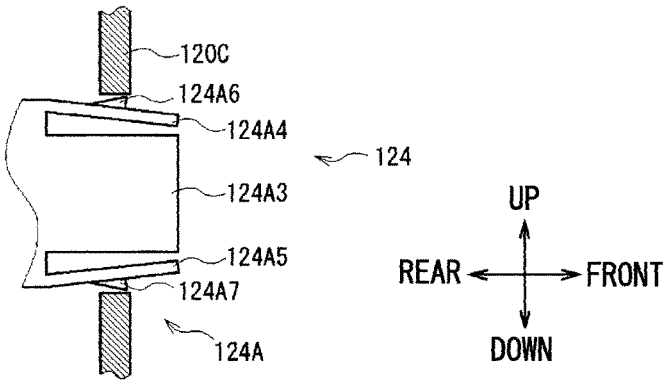
FIG. 16B is a schematic view illustrating engagement between the front side portion and the engagement portion in the second exemplary embodiment.

Next, when the side guide 124 is inserted further inside the frame 120, as illustrated in FIG. 16B, the claw portions 124A6 and 124A7 abut inner faces of the insertion hole 161 in the front side portion 120C, such that the plate-shaped portion 124A4 resiliently deforms downward, and the plate-shaped portion 124A5 resilient deforms upward.

When this is performed, similarly to in the first exemplary embodiment, the engagement projection 124B (FIG. 12) at the rear end of the side guide 124 enters the engagement hole 65A (FIG. 10) of the engagement hole group 65.

Figure 16C:
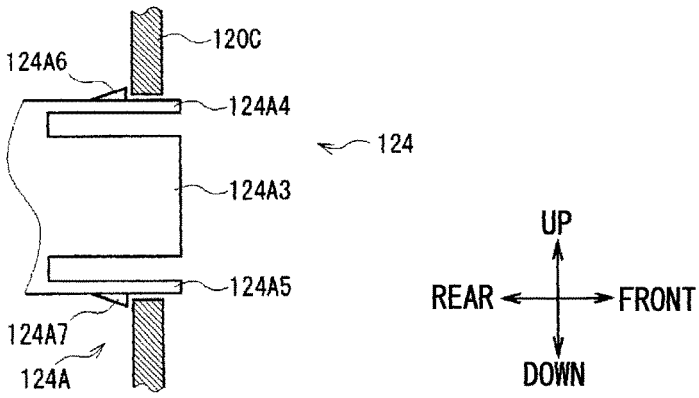
FIG. 16C is a schematic view illustrating engagement between the front side portion and the engagement portion in the second exemplary embodiment.

Finally, when the rear end portion of the side guide 124 reaches the rear side portion 120D, as illustrated in FIG. 16C, the claw portions 124A6 and 124A7 position at a rear face of the front side portion 120C.

Since the claw portions 124A6 and 124A7 no longer abut the inner faces of the insertion hole 161 in the front side portion 120C, the plate-shaped portions 124A4 and 124A5 respectively return to their natural states under the action of resilient force.

When this occurs, the claw portion 124A6 projects further to the upper side than the upper edge of the insertion hole 161 in the front side portion 120C, and the claw portion 124A7 projects further to the lower side than the lower edge of the insertion hole 161 in the front side portion 120C. As a result, the claw portions 124A6 and 124A7 engage with the rear face of the front side portion 120C, placing the side guide 124 in an attached state to the frame 120.

The side guide 124 can be retained in the attached state, namely a state inserted inside the frame 20 by passing through the region 161A of the insertion hole 161, with the engagement projection 124B engaged with the engagement hole 65A, due to the engagement between the engagement portion 124A and the front side portion 120C. The side guide 124 therefore does not naturally come out from the frame 120 toward the front.

In the attached state of the side guide 124 to the frame 120 (FIG. 16C), the engagement between the claw portions 124A6 and 124A7 and the front side portion 120C is released by resilient deformation due to an operator using their fingers or the like to apply an external force to press the plate-shaped portion 124A4 downward and press the plate-shaped portion 124A5 upward.

Next, by pulling out the side guide 124 toward the front with the plate-shaped portions 124A4 and 124A5 still resiliently deformed, the engagement portion 124A is positioned at the front of the front side portion 120C (16A) via the state illustrated in FIG. 16B. When this is performed, the engagement projection 124B at the rear end side of the side guide 124 comes out from the engagement hole 65A.

The side guide 124 is then pulled out toward the front, ultimately being pulled out from the insertion hole 161 so as to be in a state completely removed from the frame 120.

Similarly to the side guide 124, the side guides 125 to 127 can be retained in an attached state by being inserted through the respective insertion holes 162 to 164 from the front of the frame 120, engaging the engagement projections 125B to 127B with the respective engagement hole groups 66 to 68, and engaging the engagement portions 125A to 127A with the front side portion 120C.

Similarly to the side guide 124, in the attached state to the frame 120, the side guides 125 to 127 can be easily removed from the frame 120 by releasing the engagement between the engagement portions 125A to 127A and the front side portion 120C and being pulled out toward the front.

The customer interface 112 accordingly enables easy adjustment of the positions of the side guides 124 to 127 in the left-right direction simply by an operator inserting the side guides 124 to 127 into the selected regions of the insertion holes 161 to 164, and engaging the engagement projections 124B to 127A of the side guides 124 to 127 with the selected engagement holes of the engagement hole groups 65 to 68.

When this is performed, the customer interface 112 enables the engagement portions 124A and the like to be engaged with the front side portion 120C of the frame 120, simply by inserting the side guides 124 and the like furthermost toward the rear.

The customer interface 112 thereby enables a much easier attachment operation than when the cover plate 71 is attached while matching the positions of the engagement projections 24A and so on and the engagement holes 72A and so on, such as in the first exemplary embodiment.

In the customer interface 112, when removing the side guide 124, for example, the engagement can be released and the side guide 124 can be removed from inside the frame 120 by simply resiliently deforming the plate-shaped portions 124A4 and B5 of the engagement portion 124A so as to approach each other in the up-down direction, and pulling the side guide 124 out toward the front in this state.

The customer interface 112 thereby enables a much easier removal operation than when the side guide 24 is pulled out after removing the cover plate 71, as in the first exemplary embodiment.

When adjusting the attachment positions of the side guides 124 to 127 with respect to the frame 120 in the customer interface 112, it is sufficient to perform the above removal operation and attachment operation one after the other.

The customer interface 112 enables an operator to perform an adjustment operation to a desired position very easily and quickly without removing or attaching any other components, and without using tools or the like.

The customer interface 112 exhibits similar operation and effects to the first exemplary embodiment in other respects.

According to the above configuration, during assembly of the customer interface 112 of the second exemplary embodiment, the side guides 124 to 127 are inserted from the front of the frame 120 through the selected regions of the insertion holes 161 to 164 of the front side portion 120C, the engagement projections 124B to 127B are engaged with the respective engagement holes of the engagement hole groups 65 to 68, and the engagement portions 124A to 127A are engaged with the front side portion 120C. The customer interface 112 accordingly enables the front end portions and rear end portions of the side guides 124 to 127 to be attached to the frame 120 in a state adjusted to desired positions, enables this state to be retained, and also enables easy removal by simply releasing the engagement between the engagement portions 124A to 127A and the front side portion 120C.

3. Third Exemplary Embodiment

An ATM 201 (FIG. 1) according to a third exemplary embodiment differs from the ATM 1 of the first exemplary embodiment in that a banknote pay-in/pay-out device 210 is included instead of the banknote pay-in/pay-out device 10; however, other portions are configured similarly thereto.

The banknote pay-in/pay-out device 210 (FIG. 2) differs from the banknote pay-in/pay-out device 10 according to the first exemplary embodiment in that banknote cassettes 217 are included instead of the banknote cassettes 17; however, other portions such as the customer interface 12 are configured similarly thereto.

3-1. Banknote Cassette Configuration

Functionally, the banknote cassette 217 resembles the customer interface 12 of the first exemplary embodiment in that it internally collects and houses banknotes BL. The configuration of the banknote cassette 217 also partially resembles that of the customer interface 12, and has a shape resembling the customer interface 12 stood on its end.

Figure 17:
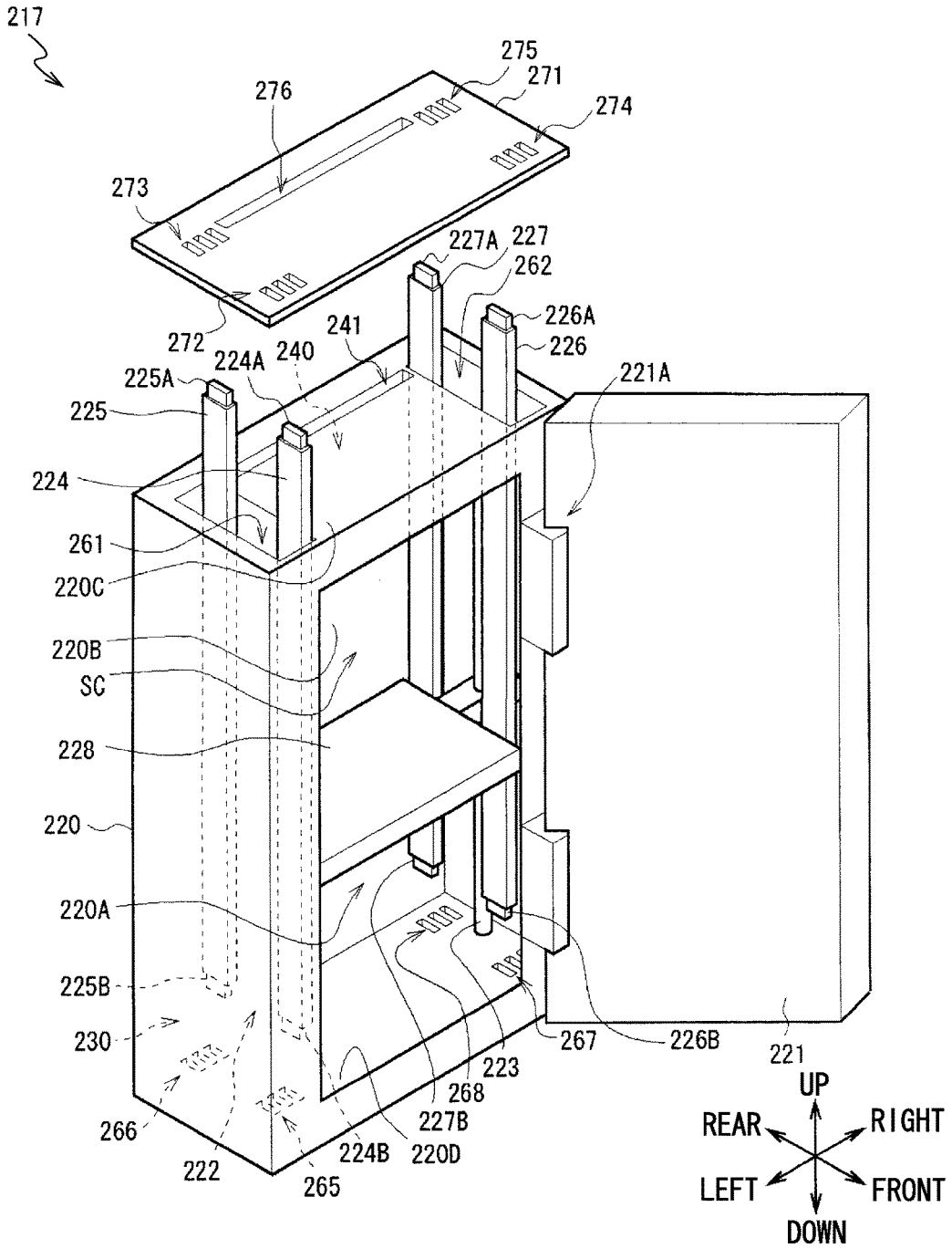
FIG. 17 is a schematic perspective view illustrating a configuration (1) of a banknote cassette according to a third exemplary embodiment.

Namely, as illustrated in FIG. 17, the banknote cassette 217 is configured centered on a frame 220 corresponding to the frame 20. The frame 220 is formed in a rectangular block shape and is closed off in the up-down direction, the left-right direction, and in the rear direction, and is open wide at a front face, in communication with the outside.

A door 221 is attached to the front of the frame 220 so as to be capable of opening and closing through a hinge 221A.

Stage guide portions 222 and 223, corresponding to the bill press guide portions 22 and 23, are provided at substantially front-rear central positions in the vicinity of a left end and in the vicinity of a right end of an internal space 220A. The stage guide portions 222 and 223 are each formed in long, thin, circular columnar shapes in the up-down direction.

Side guides 224 and 225, corresponding to the side guides 24 and 25, are respectively provided at a front side and a rear side of the stage guide portion 222. Side guides 226 and 227, corresponding to the side guides 26 and 27, are respectively provided at a front side and a rear side of the stage guide portion 223.

The side guides 224 to 227 are configured in long, thin, rectangular block shapes along the up-down direction, and, similarly to the side guides 24 to 27, restrict the positions of banknotes BL in the left-right direction inside the internal space 220A.

Upper ends and lower ends of the side guides 224 are provided with engagement projections 224A and 224B, similar to the engagement projections 24A and 24B (FIG. 8A and FIG. 8B) of the side guide 24. Upper ends and lower ends of the side guides 225 to 227 are respectively provided with engagement projections 225A to 227A, and 225B and 227B.

A stage 228 corresponding to the bill press 28 is provided inside the internal space 220A. The stage 228 is formed in a plate-shape that is thin in the up-down direction, and partitions the internal space 220A in the up-down direction.

Stage arm portions extend toward the outside at both left and right side faces of the stage 228. Holes penetrate the stage arm portions from top to bottom, and the stage guide portions 222 and 223 are inserted through the holes.

The stage 228 is driven by a stage drive section 230 corresponding to the bill press drive section 30. Some of the components configuring the stage drive section 230 are respectively disposed at the left side of the side guides 224 and 225 and at the right side of the side guides 226 and 227.

In the third exemplary embodiment, a collection space SC is configured by a space enclosed by an upper side portion 220C of the frame 220 and the stage 228 to the top and bottom, enclosed by a rear side portion 220B of the frame 220 and the door 221 to the front and rear, and enclosed by the side guides 224 to 227 to the left and right.

An entry/exit section 240 that exchanges banknotes BL with the conveyance section 13 (FIG. 2) is provided to the upper side portion 220C of the frame 220. By rotation driving rollers, not illustrated in the drawings, as appropriate, the entry/exit section 240 takes banknotes BL inside the internal space 220A through a slit 241 provided in the upper side portion 220C, and passes banknotes BL that have been fed out from inside the internal space 220A to the conveyance section 13 through the slit 241.

The left and right of the upper side portion 220C of the frame 220 is provided with insertion holes 261 and 262, corresponding to the insertion holes 61 and 62.

The insertion hole 261 penetrates the upper side portion 220C in the up-down direction, enabling insertion of the side guides 224 and 225 inside the internal space 220A from above the frame 220. The insertion hole 262 also penetrates the upper side portion 220C in the up-down direction, enabling insertion of the side guides 226 and 227 inside the internal space 220A from above the frame 220.

Engagement hole groups 265, 266, 267, and 268, respectively corresponding to the engagement hole groups 65, 66, 67, and 68 (FIG. 10), are respectively provided at the front left, rear left, front right, and rear right of an upper face (namely an inner face) of a lower side portion 220D of the frame 220.

Each of the engagement hole groups 265 to 268 is configured by engagement holes at three locations in a row in the left-right direction, similarly to the engagement hole groups 65 to 68.

Similarly to the engagement hole groups 65 to 68, the engagement hole groups 265 to 268 accordingly enable the positions of lower ends of the side guides 224 to 227 to be adjusted in the left-right direction, by engaging the engagement projections 224B to 227B with selected engagement holes.

A cover plate 271, corresponding to the cover plate 71, is attached at an upper face of the upper side portion 220C of the frame 220.

The cover plate 271 is provided with engagement hole groups 272, 273, 274, and 275 respectively corresponding to the engagement hole groups 72, 73, 74, and 75. Similarly to the engagement hole groups 72 to 75, each of the engagement hole groups 272 to 275 is configured by engagement holes at three locations in a row in the left-right direction.

Similarly to the engagement hole groups 72 to 75, the engagement hole groups 272 to 275 accordingly enable the positions of upper ends of the side guides 224 to 227 to be adjusted in the left-right direction, by engaging the engagement projections 224A to 227A with selected engagement holes when attaching the cover plate 271 to the upper side portion 220C.

The cover plate 271 is provided with a slit 276 for passing the banknotes BL through, at a location corresponding to the slit 241 of the entry/exit section 240.

The banknote cassette 217 accordingly enables adjustment of the positions of the side guides 224 to 227 in the left-right direction by engaging the respective lower and upper engagement projections 224B to 227B and 224A to 227A of the side guides 224 to 227 with one of the engagement holes provided at three locations in each of the respective engagement hole groups 265 to 268 and 272 to 275.

3-2. Operation and Effects

In the banknote cassette 217 of the third exemplary embodiment configured as described above, the engagement projections 224A to 227A, and 224B to 227B, are respectively provided at the upper ends and lower ends of the side guides 224 to 227.

The frame 220 of the banknote cassette 217 is provided with the respective insertion holes 261 and 262 at the upper side portion 220C, and is provided with the engagement hole groups 265 to 268 in which the engagement holes 265A to 265C, etc. respectively at three locations are arranged in a line along the left-right direction at the lower side portion 220D.

The cover plate 217 is provided with the engagement hole groups 272 to 275 in which the respective engagement holes 272A to 272C, etc. are provided at three locations arranged in a line along the left-right direction.

In the manufacturing processes of the banknote cassette 217, the side guides 224 and 225 are inserted through the insertion hole 261 of the of the upper side portion 220C, and the side guides 226 and 227 are inserted through the insertion hole 262 of the upper side portion 220C, in an assembled state of the stage guide portions 222 and 223, the stage drive section 230 and the like to the frame 220.

When this is performed, among the three engagement holes provided in each of the engagement hole groups 265 to 268, an operator or the like engages the engagement projections 224B to 227B provided to the respective lower ends of the side guides 224 to 227 with the respective engagement holes corresponding to the length direction length of the banknotes BL to be handled.

Figure 18:
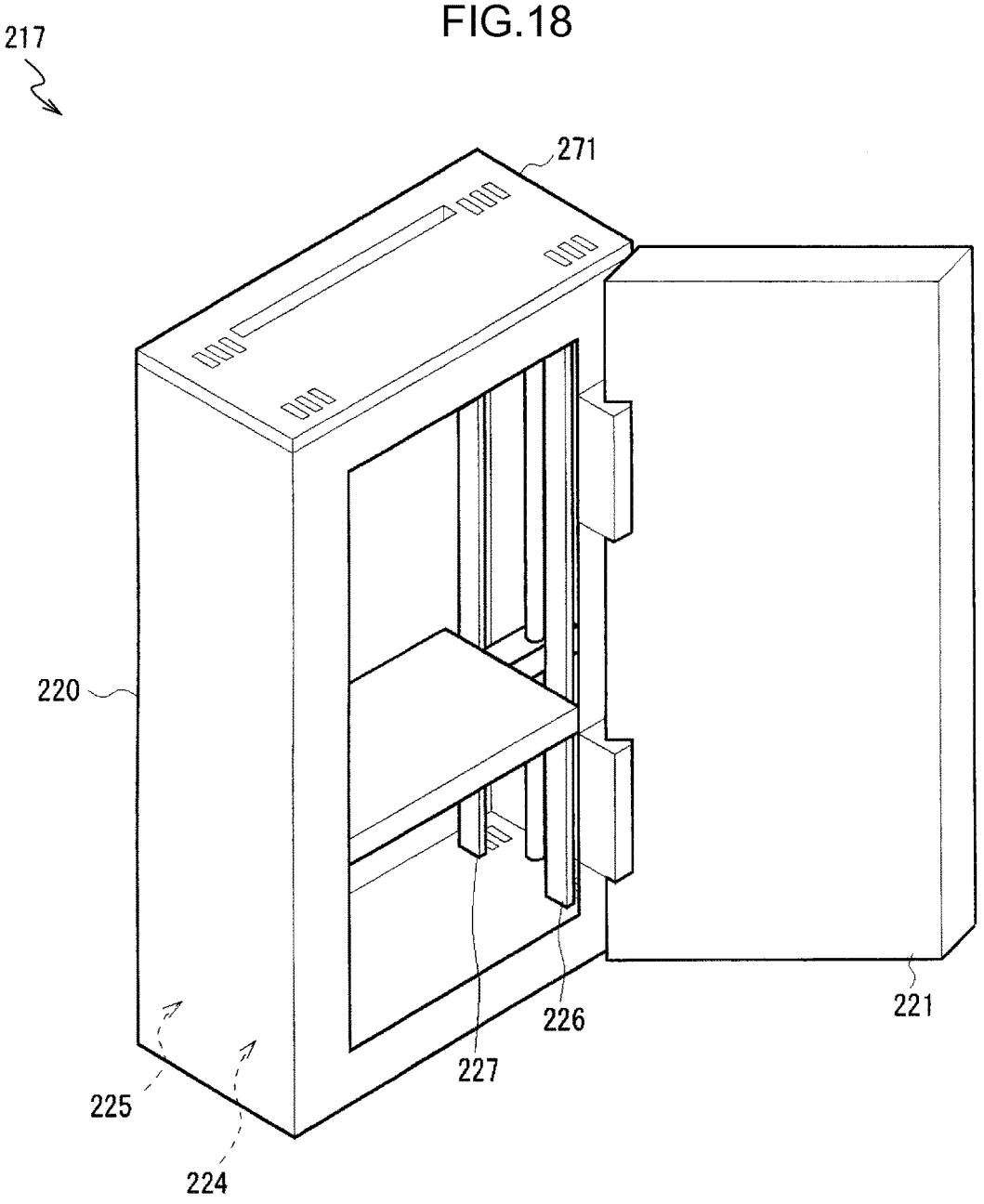
FIG. 18 is a schematic perspective view illustrating a configuration (2) of the banknote cassette according to the third exemplary embodiment.

Next, in the banknote cassette 217, as illustrated in FIG. 18, the cover plate 271 is attached to the upper side portion 220C of the frame 220.

When this is performed, among the three engagement holes provided in each of the engagement hole groups 272 to 275, the operator or the like engages the engagement projections 224A to 227A provided to the respective upper ends of the side guides 224 to 227 with the respective engagement holes corresponding to the length direction length of the banknotes BL to be handled.

This thereby enables adjustment of the side guides 224 to 227 such that the length of the collection space SC in the left-right direction is slightly longer than the longest length in the length direction of any banknotes BL to be handled.

Similarly to the first exemplary embodiment, during the manufacturing process of the banknote cassette 217, the positions of the side guides 224 to 227 in the left-right direction can be easily adjusted by an operator simply by engaging the engagement projections 224B to 227B and 224A to 227A of the side guides 224 to 227 with the selected engagement holes of the engagement hole groups 265 to 268 and 272 to 275.

In the banknote cassette 217, even when the length of the collection space SC in the left-right direction is changed after manufacture, the engaged state between respective engagement projections of the side guides 224 to 227 and the respective engagement holes of the engagement hole groups can be released by the very simple operation of removing the cover plate 271 from the upper side portion 220C of the frame 220, and the attachment positions can be quickly changed.

The banknote cassette 217 moreover exhibits similar operation and effects to the customer interface 12 of the first exemplary embodiment in other respects.

Due to the above configuration, during assembly of the banknote cassette 217 of the third exemplary embodiment, an operator may attach the cover plate 271 to the upper side portion 220C of the frame 220 while engaging the engagement projections 224B to 227B of the side guides 224 to 227 with the selected engagement holes of the engagement hole groups 265 to 268, and engaging the engagement projections 224A to 227A to the selected engagement holes out of the engagement hole groups 272 to 275. The banknote cassette 217 thereby enables easy adjustment of the attachment positions of the side guides 224 to 227 by a simple operation from the outside of the frame 220, without any major dismantling, even after assembly.

4. Other Exemplary Embodiments

In the first exemplary embodiment described above, explanation has been given regarding a case in which the positions of the rear end portions of the side guides 24 to 27 are fixed with respect to the frame 20 by engaging the engagement projections 24A to 27A provided to the respective rear end portions of the side guides 24 to 27 with the respective engagement holes of the engagement hole groups 65 to 68 formed to the rear side portion 20D of the frame 20.

There is, however, no limitation to such an exemplary embodiment, and the positions of the rear end portions of the side guides 24 to 27 may be fixed with respect to the frame 20 by engaging various mutually engaging shapes together. For example, engagement holes may be formed to the respective rear end portions of the side guides 24 to 27, and plural engagement projections may be provided projecting out from the rear side portion 20D, and the engagement holes and engagement projections may be engaged together. In such cases, in consideration of the insertion direction of the side guides 24 to 27, engagement is preferably made and released by moving the side guides 24 to 27 along the front-rear direction. The same applies to the front end portions of the side guides 24 to 27, and the same also applies to the second and third exemplary embodiments.

In the first exemplary embodiment described above, explanation has been given regarding a case in which the front end portions of the side guides 24 to 27 are fixed when the cover plate 71 is fixed to the frame 20, and the fixing of the front end portions of the side guides 24 to 27 is released when the cover plate 71 is removed from the frame 20.

There is, however, no limitation to such an exemplary embodiment, and, for example, a lower edge of the cover plate 71 may be attached to a front face of the front side portion 20C of the frame 20 through a hinge. In such a configuration, the front end portions of the side guides 24 to 27 may be fixed by using a specific lock member to lock the cover plate 71 in a state contacting the front side portion 20C, and the fixing of the front end portions of the side guides 24 to 27 may be released by releasing locking, and swinging the cover plate 71. The same also applies to the third exemplary embodiment.

In the first exemplary embodiment described above, explanation has been given regarding a case in which the side guides 24 to 27 are configured with front-rear symmetrical shapes, the engagement projections 24A to 27A and 24B to 27B have substantially the same shapes as each other, and the respective engagement holes of the engagement hole groups 65 to 68 and the respective engagement holes of the engagement hole groups 72 to 75 have substantially the same shapes as each other.

There is, however, no limitation to such an exemplary embodiment, and, for example, the side guides 24 to 27 may have front-rear asymmetrical shapes, the engagement projections 24A to 27A and 24B to 27B may have different shapes to each other, and the respective engagement holes of the engagement hole groups 65 to 68 and the respective engagement holes of the engagement hole groups 72 to 75 may have different shapes to each other. This enables to prevent operation errors, for example, due to an operator mistakenly attaching the side guides 24 to 27 the wrong way around in the front-rear direction in cases in which the attachment direction of the side guides 24 to 27 is determined in the front-rear direction, from occuring. The same also applies to the third exemplary embodiment.

In the first exemplary embodiment described above, explanation has been given regarding a case in which each of the side guides 24 to 27 has a rectangular block shape that is long and thin in the front-rear direction.

There is, however, no limitation to such an exemplary embodiment, and, for example, the up-down direction lengths of the side guides 24 and 25 may differ, and, for example, corners (edges) of side faces that contact the banknotes BL may be configured in various shapes, for example beveled or rounded. The same also applies to the second and third exemplary embodiments.

In the second exemplary embodiment described above, explanation has been given regarding a case in which in the engagement portions 124A of the side guides 124 and the like, the respective claw portions 124A6 and 124A7 are provided to the plate-shaped portions 124A4 and 124A5 that undergo resilient deformation, and are engaged with the front side portion 120C.

There is, however, no limitation to such an exemplary embodiment, and the side guides 124 and the like may be engaged with the front side portion 120C by various methods, such as by forming plate-shaped portions and claw portions on the front side portion 120C, and engaging these claw portions with the side guides 124 and the like.

In the second exemplary embodiment described above, explanation has been given regarding a case in which the engagement projections 124B to 127B are formed to the rear end portions of the side guides 124 to 127 similarly to in the first exemplary embodiment, and are engaged with the engagement hole groups 65 to 68 formed to the rear side portion 120D of the frame 120.

There is, however, no limitation to such an exemplary embodiment, and, for example, engagement portions configured similarly to those at the front end portions may be provided to the rear end portions of the side guides 124 to 127, and insertion holes with similar shapes to those of the front side portion 120C may be provided to the rear side portion 120D of the frame 120. In such a configuration, the side guides 124 to 127 may be inserted or pulled out from either the front or the rear of the frame 120.

In the first exemplary embodiment described above, explanation has been given regarding a case in which the bill press guide portions 22 and 23 are provided at substantially the top-to-bottom center at both left and right ends inside the frame 20, and the side guides 24 and 25, and 26 and 27, are attached above and below the bill press guide portions 22 and 23, namely two each on the left and right.

There is, however, no limitation to such an exemplary embodiment, and, for example, the bill press guide portions 22 and 23 may be provided in the vicinity of lower ends on both the left and right inside the frame 20, and side guides may be attached at the upper sides thereof such that there is one each on the left and right. Namely, a desired number of side guides may be respectively attached on the left and right at positions capable of restricting the positions of the banknotes BL in the left-right direction, while avoiding interference with members for moving the bill press 28, etc. along the front-rear direction within the frame 20 (such as the bill press drive section 30 and the bill press guide portions 22 and 23). Theh same also applies to the second and third exemplary embodiments.

In the first exemplary embodiment described above, explanation has been given regarding a case in which the engagement hole groups 65 to 68 and 72 to 75 are each provided with engagement holes at three locations.

There is, however, no limitation to such an exemplary embodiment, and two, or four or more engagement holes may be provided to the engagement hole groups 65 to 68 and 72 to 75. The number of engagement holes may vary between the respective engagement hole groups. The direction in which the engagement holes are aligned is also not limited to the left-right direction, and, for example, may be a diagonal direction. The same also applies to the second and third exemplary embodiments.

In the first exemplary embodiment described above, explanation has been given regarding a case in which the insertion holes 61 and 62 are provided to the front side portion 20C at two locations, the side guides 24 and 25 are inserted through the insertion hole 61, and the side guides 26 and 27 are inserted through the insertion hole 62.

There is, however, no limitation to such an exemplary embodiment, and, for example, insertion holes may be provided to the front side portion 20C at four locations corresponding to the side guides 24 to 27, or respective insertion holes may be provided at 12 locations corresponding to each of the engagement holes. The same also applies to the third exemplary embodiment.

In the first and second exemplary embodiments described above, explanation has been given regarding examples applied to the customer interfaces 12 and 112, and in the third exemplary embodiment described above, explanation has been given regarding an example applied to the banknote cassette 217.

There is, however, no limitation to such exemplary embodiments, and, for example, application may be made to other sections provided inside the banknote pay-in/pay-out device 10, such as the reject cassette 16 (FIG. 2). In such configurations, as the applicable section, it is sufficient to be a location at which a bill press or stage is moved along the collection direction of the banknotes BL within a space formed inside the section, and that banknotes BL can be collected in a collection space SC partitioned by the bill press or stage.

In the first exemplary embodiment described above, explanation has been given regarding an example in which application is made to the customer interface 12 that internally collects banknotes BL, serving as a medium, in the ATM 1 that performs processing for cash transactions with a user.

There is, however, no limitation thereto, and, for example, application may be made to a location where banknotes BL are internally collected in various banknote BL handling devices, such as a banknote processing device (known as a teller machine) used by a cashier at a service counter in a financial institution or the like. Application may also be made to locations where various media such securities or cash vouchers as are internally collected. The same also applies to the second and third exemplary embodiments.

In the first exemplary embodiment described above, explanation has been given regarding a case in which the customer interface 12, serving as a medium housing device, is configured by the frame 20 serving as a frame, the bill press 28 serving as a partitioning plate, the bill press guide portions 22 and 23 and the bill press drive section 30 that serve as a partitioning plate moving section, the side guides 24 to 27 serving as side guides, the engagement hole groups 65 to 68 and 72 to 75 serving as positioning portions, and the cover plate 71 serving as a retention switching portion.

There is, however, no limitation to such an exemplary embodiment, and a medium housing device may be configured by frames, partitioning plates, partitioning plate moving sections, side guides, positioning portions, and retention switching portions of various other configurations.

In the first exemplary embodiment described above, explanation has been given regarding a case in which the ATM 1, serving as a medium processing device, is configured by the conveyance section 13 serving as a conveyance section, the frame 20 serving as a frame, the bill press 28 serving as a partitioning plate, the bill press guide portions 22 and 23 and the bill press drive section 30 serving as a partitioning plate moving section, the side guides 24 to 27 serving as side guides, the engagement hole groups 65 to 68 and 72 to 75 serving as positioning portions, and the cover plate 71 serving as a retention switching portion.

There is, however, no limitation to such an exemplary embodiment, and a medium processing device may be configured by conveyance sections, frames, partitioning plates, partitioning plate moving sections, side guides, positioning portions, and retention switching portions of various other configurations.

INDUSTRIAL APPLICABILITY

The present exemplary embodiment may be employed in various devices in which various types of media are collected in an internal collection space.

The invention claimed is:

1. A medium housing device comprising:

a frame internally including an internal space in which a medium is housed;

a partitioning plate that partitions the internal space in an intersecting direction intersecting with a collection direction, to form a collection space in which the medium is collected along the collection direction;

a partitioning plate moving section that moves the partitioning plate along the collection direction with respect to the frame;

a side guide that is attached inside the frame at a location not interfering with a movement range of the partitioning plate moved by the partitioning plate moving section, and that defines a size of the collection space in the intersecting direction, the side guide having first and second end portions in the collection direction thereof;

a plurality of first positioning members and a plurality of second positioning members that respectively provide a plurality of attachment positions for the side guide, each first positioning member being in alignment with a corresponding second positioning member with respect to the collection direction, each first and second positioning members respectively positioning the first and second end portions of the side guide at a selected one of the plurality of attachment positions so that the side guide extends in a direction parallel to the collection direction, the size of the collection space being changeable depending on the position of the first and second end portions relative to the attachment positions; and a retention switching member that switches between a retained state in which the first and second end portions of the side guide is positioned at the selected one of the plurality of attachment positions, and a retention-released state in which one of the first and second end portions of the side guide is not positioned at the selected one of the plurality of attachment positions.

2. The medium housing device of claim 1, wherein the frame has an insertion hole at an end portion thereof, the side guide being inserted through the insertion hole between the internal space and an outside of the frame, and wherein the retention switching member is comprised of a detachable portion that is placed in the retained state covering at least a portion of the insertion hole when mounted to the end portion of the frame, and that adopts the retention-released state opening up the insertion hole when removed from the end portion of the frame.

3. The medium housing device of claim 2, wherein the plurality of first positioning members are respectively a plurality of engaged-with portions formed in the detachable portion, each engaged-with portion corresponding to a respective one of the plurality of attachment positions, and the side guide has an engagement portion at the first end portion thereof, the engagement portion engaging with one of the plurality of engaged-with portions corresponding to the selected one of the plurality of attachment positions.

4. The medium housing device of claim 3, wherein the side guide has a symmetrical shape in the collection direction and is provided with an opposite side engagement portion having substantially a same shape as the engagement portion, the opposite side engagement portion being formed at the second end portion on an opposite side of the first end portion.

5. The medium housing device of claim 1, wherein the plurality of first positioning members are respectively a plurality of holes formed in the frame, each hole corresponding to one of the plurality of attachment positions, and the side guide has a projection that is positioned by being inserted into one of the plurality of holes corresponding to the selected one of the plurality of attachment positions.

6. The medium housing device of claim 1, wherein the frame has an insertion hole at an end portion thereof, the side guide being inserted between the internal space and an outside of the internal space, and wherein the plurality of first positioning members are formed in a peripheral area of the insertion hole, and determine a position of the side guide in the intersecting direction.

7. The medium housing device of claim 6, wherein the retention switching member includes first and second members, each member being provided at one of the first and second end portions of the side guide, adopting the retained state when engaged with one of the plurality of first positioning members, and adopting the retention-released state when disengaged with the one of the plurality of first positioning members.

8. A medium processing device comprising:

the medium housing device of claim 1; and a conveyance section that conveys the medium, wherein the frame houses in the internal space the medium conveyed in by the conveyance section, or the medium to be conveyed out the conveyance section.

9. The medium housing device of claim 1, further comprising a component attached to the frame, wherein the plurality of first positioning members are respectively a plurality of holes formed in the component, each hole corresponding to one of the plurality of attachment positions, and the side guide has a projection that is positioned by being inserted into one of the plurality of holes corresponding to the selected one of the plurality of attachment positions.

* * * * *